US010977922B2

(12) United States Patent
Boyle

(10) Patent No.: US 10,977,922 B2
(45) Date of Patent: Apr. 13, 2021

(54) WATER SAFETY ALARM AND SUPERVISION AID INCLUDING METHODOLOGY EMBODIED IN THE ALARM FOR ALERTING A THIRD PARTY VIA A COMMUNICATIONS NETWORK

(71) Applicant: Norman Boyle, Merimbula (AU)

(72) Inventor: Norman Boyle, Merimbula (AU)

( * ) Notice: Subject to any disclaimer, the term of this patent is extended or adjusted under 35 U.S.C. 154(b) by 0 days.

(21) Appl. No.: 16/395,392

(22) Filed: Apr. 26, 2019

(65) Prior Publication Data

US 2019/0333356 A1 Oct. 31, 2019

(30) Foreign Application Priority Data

Apr. 30, 2018 (AU) ..... 2018901418
Apr. 7, 2019 (AU) ..... 2019100378

(51) Int. Cl.
*G08B 21/08* (2006.01)

(52) U.S. Cl.
CPC ..... *G08B 21/088* (2013.01)

(58) Field of Classification Search
CPC ..... G08B 21/088; G08B 21/08
USPC ..... 340/573.6
See application file for complete search history.

(56) References Cited

U.S. PATENT DOCUMENTS 5,486,814 A 1/1996 Quinones
6,157,303 A * 12/2000 Bodie ..... B63C 9/0005 340/539.1
7,642,921 B2 * 1/2010 Cutler ..... G08B 21/088 340/573.6
9,460,602 B2 * 10/2016 Calhoun ..... G08B 21/088
9,666,054 B2 * 5/2017 Matko ..... G08B 21/086
2003/0222782 A1 * 12/2003 Gaudreau ..... G08B 21/082 340/573.6

(Continued)

FOREIGN PATENT DOCUMENTS

CN 105869357 A 8/2016
FR 2847059 A1 5/2004
WO 03015045 A1 2/2003

OTHER PUBLICATIONS

Australian Application No. AU2019100378 Innovation Examination Report No. 1, dated Jun. 5, 2019, 7 pages.

(Continued)

*Primary Examiner* — Eric Blount
(74) *Attorney, Agent, or Firm* — Cynthia M. Gilbert; Blueshift IP

(57) ABSTRACT

Disclosed herein is an electronic method for monitoring a wearable device, the device being in communication with a receiving device, comprising the steps of, transmitting, from the wearable device via a wireless communications protocol, an encoded signal capable of being received by the receiving device, the encoded signal including information identifying the wearable device and information regarding the status of the device, wherein, upon receipt of the encoded signal, the receiving device decodes the signal, and dependent on the received information regarding the status of the wearable device, the receiving device performs one or more of sending a broadcast signal including the encoded signal via a transceiver, sending the encoded signal to a second receiving device via a wireless communications network, sending an alarm signal to a second device and sounding an alarm.

6 Claims, 12 Drawing Sheets

(56) References Cited

U.S. PATENT DOCUMENTS

| | | | | |
|---|---|---|---|---|
| 2008/0150733 | A1* | 6/2008 | Snyder | G08B 21/088 340/573.6 |
| 2008/0266118 | A1 | 10/2008 | Pierson | |
| 2008/0278338 | A1 | 11/2008 | Krell | |
| 2008/0297176 | A1* | 12/2008 | Douglas | H03K 17/955 324/686 |
| 2011/0148642 | A1 | 6/2011 | Cutler | |
| 2011/0241887 | A1* | 10/2011 | McKinney | G08B 21/088 340/573.6 |
| 2015/0154846 | A1* | 6/2015 | Calhoun | G08B 21/088 340/573.6 |
| 2016/0042629 | A1 | 2/2016 | Snyder | |
| 2017/0124841 | A1* | 5/2017 | Snyder | G08B 21/088 |
| 2018/0040223 | A1 | 2/2018 | Bodi | |
| 2019/0066478 | A1* | 2/2019 | Reich | G08B 21/0211 |

OTHER PUBLICATIONS

Australian Application No. AU2019100378 Innovation Examination Report No. 2, dated Dec. 3, 2019, 7 pages.
Search & Written Opinion of European Patent Office dated Sep. 18, 2019, in European patent application No. 3564919, 9 pages.

* cited by examiner

WATER SAFETY ALARM AND SUPERVISION AID INCLUDING METHODOLOGY EMBODIED IN THE ALARM FOR ALERTING A THIRD PARTY VIA A COMMUNICATIONS NETWORK

CROSS-REFERENCE TO RELATED APPLICATIONS

This application claims priority under 35 U.S.C. § 119 to Australian patent application number 2018901418, filed Apr. 30, 2018, the disclosure of which is incorporated herein by reference, and this application claims priority under 35 U.S.C. § 119 to Australian patent application number 2019100378, filed Apr. 7, 2019, the disclosure of which is incorporated herein by reference.

TECHNICAL FIELD

The present invention relates to wearable devices that cause an alarm when immersed in water and to a system and method including a communications methodology embodied in a device for alerting a third-party via a communications network.

BACKGROUND ART

Drowning is an ever present risk in many environments, including the home environment. Children especially do not comprehend the danger of water and drownings can occur in only a few unsupervised minutes. Whilst nothing can replace direct supervision of children, many devices are available commercially which, when operated correctly, can reduce the risk of drowning.

For example, wearable devices that provide an alert in the event of the device being immersed in water (which is indicative of the wearer being in the water and potentially in danger) are known. Such devices are worn (typically by children, but also by other users such as disabled adults or pets) and will cause an alarm to be triggered in the event of the device being immersed in water.

However, such devices are also potentially limited in their ability to reduce the risk of drowning in that a person must still be physically near the user wearing the device in order to hear the alarm and take action within a reasonable time. Where a person is not near the user, auditory warnings may be of limited or no use. Furthermore, the device must be being worn at the time the child (etc.) enters the water in order to be effective.

SUMMARY OF INVENTION

In a first aspect, there is provided an electronic method for monitoring a wearable device, the device being in communication with a receiving device, comprising the steps of, transmitting, from the wearable device via a wireless communications protocol, an encoded signal capable of being received by the receiving device, the encoded signal including information identifying the wearable device and information regarding the status of the device, wherein, upon receipt of the encoded signal, the receiving device decodes the signal, and dependent on the received information regarding the status of the wearable device, the receiving device performs one or more of sending a broadcast signal including the encoded signal via a transceiver, sending the encoded signal to a second receiving device via a wireless communications network, sending an alarm signal to a second device and sounding an alarm.

In one embodiment, the receiving device includes the further step of, upon not receiving an encoded signal within a predetermined time, sending an alarm signal to a second device, whereby, optionally, the receiving device is capable of receiving an acknowledgement signal from the second device, whereby, upon not receiving an acknowledgement signal within a predetermined time, the receiving device performs the further step of resending the alarm signal to the second device.

In one embodiment, the step of sounding an alarm includes the steps of sounding at least one of an audible alarm and a visual alarm.

In one embodiment, the receiving device includes a transceiver capable of performing the further step of sending a command signal to one or more of the wearable device and the second receiving device, the command signal including information arranged to alter information in the wearable device and the second receiving device.

In one embodiment, at least one of the receiving device and the second receiving device is one of a repeater unit and a mobile computing system.

In a second aspect, the present invention provides a wearable device comprising a transmitter for transmitting a signal that is detectable by a remote device configured to cause an alarm if the signal is indicative of the device being immersed in water, and an interchangeable visual feature.

In a third aspect, the present invention provides a wearable device comprising a sensor for sensing immersion of the device in water, a transmitter for transmitting a signal when the device is immersed in water, the signal being detectable by a remote device configured to cause an alarm upon detection of the signal, and an interchangeable visual feature.

The present invention advantageously provides a wearable device that, similar to other currently available devices, causes an alarm upon its immersion in water. Unlike other currently available devices, however, the device of the present invention includes an interchangeable visual feature, which introduces an element of desirability to the device. The wearable device of the present invention is more likely to be viewed by the wearer as an adornment or fashion accessory, and therefore more likely to be worn continuously. Wearable devices which warn of an immersion in water, but which are not worn, are not effective. This is especially the case when the wearer is a child and the risk of drowning is ever-present, even in household environments. The wearable device of the present invention seeks to address this deficiency of currently available devices, which was recognised by the present inventor and, in doing so, be more likely to prevent accidental drownings.

In some embodiments, the interchangeable visual feature may be configured to be releasably attachable to the device. The interchangeable visual feature may, for example, comprise a cover for the device, which is visible when worn (e.g. a cover for an outwardly-facing portion of the device). The cover may, in some embodiments, be configured to be releasably fastenable to a body of the device.

In some embodiments, the interchangeable visual feature may comprise indicia. Such indicia may, for example, be visually attractive to children. As noted above, visually attractive features such as removable caps or covers for the device can significantly increase the appeal of the device and hence the likelihood of the wearer choosing to wear the device at all times.

It is envisaged that interchangeable visual features appealing to many different demographics (children, in particular) can be provided, with possibly hundreds or thousands of different visual features being able to cater to all ages and interests. As the visual features are interchangeable, they can be switched in order to reflect changes in ages and interests, for example, as a child grows up.

In some embodiments, the device is configured to be permanently worn, that is, worn the majority of the time and especially during the daytime when the majority of accidental drownings would be likely to occur. The device may, for example, comprise a band configured to fit around a limb of a wearer. Such a band may, in some embodiments, be stretchable for positioning at the limb of the wearer. A force required to stretch the band before it can be removed from the limb of the wearer may be of a magnitude that discourages or even prevents the device from being removed by a child. In some embodiments, the device may be configured for wearing on the ankle, wrist or neck of a person.

In some embodiments of the second aspect of the present invention, the wearable device need not include a sensor for sensing immersion of the device in water. In such embodiments, for example, the transmitter may be configured to transmit a signal which is attenuated when the device is immersed in water, where the attenuated signal is indicative of the device being immersed in water and which causes the alarm. In some embodiments, for example, the absence of a regular signal from the transmitter (which may be caused because the water in which the device is immersed effectively blocks the transmitted signal) may be indicative of the device being immersed in water and thus trigger the alarm.

In other embodiments of the second aspect of the present invention, however, the wearable device may further comprise a sensor for sensing immersion of the device in water, wherein the signal indicative of the device being immersed in water is caused to be transmitted when the sensor detects that the device is immersed in water.

In some embodiments, the sensor for sensing immersion of the device in water may comprise a material which expands upon contact with water. In alternative embodiments, the sensor for sensing immersion of the device in water may comprise a water sensor circuit.

In some embodiments, the remote device that detects the signal may be a (primary) mobile computing device (e.g. the mobile telephone of the primary carer for the person on that day). In some embodiments, the remote device that detects the signal may be a base station or repeater which is itself in communication with the primary mobile computing device. In such embodiments, the alarm may comprise an alarm protocol operated by a software application on the mobile computing device. The alarm protocol may comprise activating an alarm on the mobile device immediately upon detecting the signal. The alarm protocol may comprise activating an alarm on one or more secondary mobile computing devices, if the alarm on the primary mobile computing device is not cancelled within a predetermined time. Such protocols ensure that at least one person should be notified immediately upon the wearer of the device entering water. In the event of that person not acknowledging the alarm (and its implications), another person or other people (e.g. neighbours) are notified as a safeguard.

The alarm protocol may comprise repeating an alarm on the (primary) mobile computing device if the wearable device is still immersed in water a predetermined time after the preceding alarm was cancelled. Such repetition is intended to remind the primary carer that the wearer of the device is still in the water, and that they therefore need to remain vigilant. The predetermined time would typically be 3 minutes or less, this being the time when brain damage starts to occur if the person is underwater.

The benefits of such a supervision aid are immediately apparent and considered to be worth the inconvenience of multiple alarms. It is important that children especially are supervised whilst in and around water, and that constant vigilance be maintained for the entire time they spend in the water. The inventor recognised that, whilst many of the currently available devices trigger an alarm in the event of a child entering water, they do not provide a functionality whereby the person responsible for supervising the child is repeatedly prompted to check on them whilst they remain in the water. The subsequent alarm(s) would help to maintain a substantially continues supervision, notwithstanding everyday distractions such as a doorbell or telephone ringing.

In a fourth aspect, the present invention provides an alarm protocol for use with a wearable device configured to transmit a signal that is detectable by a remote device configured to cause an alarm if the signal is indicative of the device being immersed in water. The protocol comprises activating an alarm on a primary mobile computing device upon the remote device detecting the signal, activating an alarm on one or more secondary mobile computing devices, if the alarm on the primary mobile computing device is not cancelled within a predetermined period, and repeating the alarm on the primary mobile computing device a predetermined time after the preceding alarm was cancelled, until the wearable device is no longer immersed in water.

In a fifth aspect, the present invention provides a software application configured to operate an alarm protocol on a primary mobile computing device upon receiving information, via a wireless communication network, indicative of a wearable device in communication with the mobile computing device being immersed in water. The alarm protocol comprises activating an alarm on the primary mobile computing device upon receiving the information, activating an alarm on one or more secondary mobile computing devices if the alarm on the primary mobile computing device is not cancelled within a predetermined period, and repeating the alarm on the primary mobile computing device a predetermined time after the preceding alarm was cancelled, until information indicative of the wearable device no longer being immersed in water is received.

In a sixth aspect, the present invention provides a software application configured to operate the alarm protocol of the fourth aspect of the present invention upon receiving information indicative of the wearable device being immersed in water.

In a seventh aspect, the present invention provides a combination of a wearable device configured to transmit a signal when immersed in water and a mobile computing device operating a software application configured to initiate an alarm protocol upon detection of the signal.

In some embodiments of the combination of the seventh aspect of the present invention, the wearable device is the wearable device of the second or third aspect of the present invention. In some embodiments of the combination of the seventh aspect of the present invention, the alarm protocol is the alarm protocol of the fourth aspect of the present invention.

Additional features and advantages of the various aspects of the present invention will be described below in the context of specific embodiments. It will be appreciated, however, that such additional features may have a more general applicability in the present invention than that described in the context of these specific embodiments.

BRIEF DESCRIPTION OF DRAWINGS

Embodiments of the present invention will be described in further detail below with reference to the following drawings, in which.

DESCRIPTION OF EMBODIMENTS

Figure 1A:
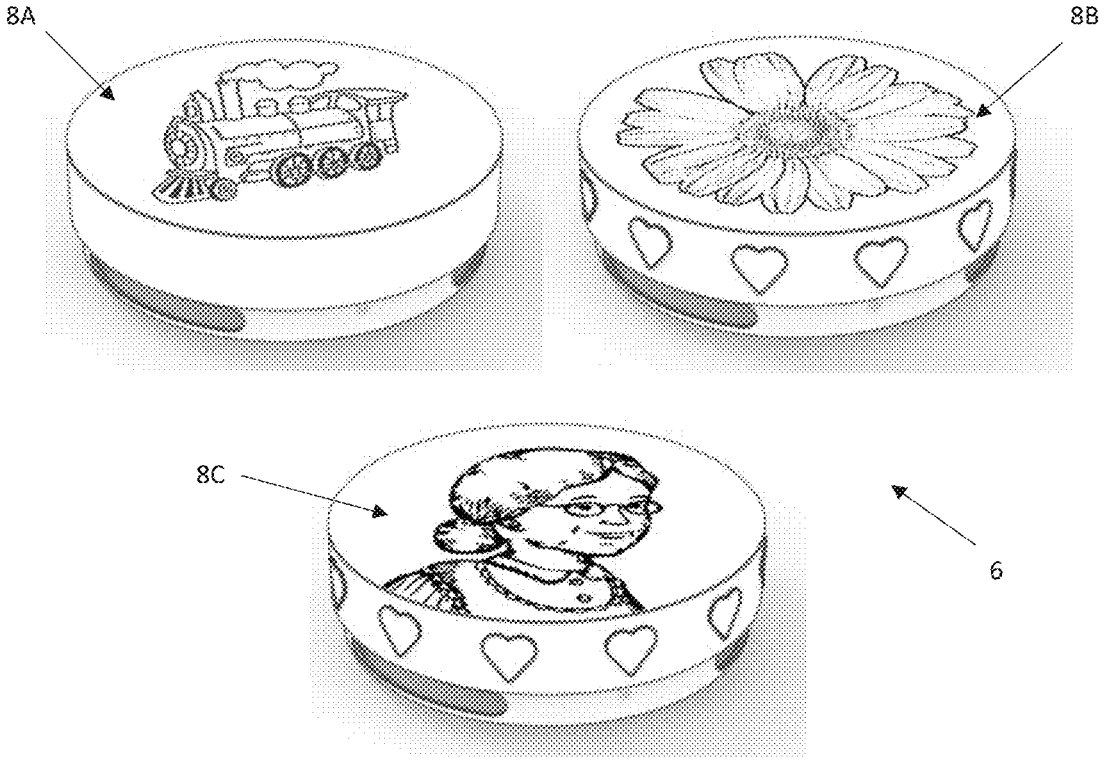
FIG. 1A shows a perspective view of wearable devices in accordance with embodiments of the present invention having different visual features.

As noted above, the present invention provides a wearable device for providing an alarm in the event of the device (and hence its wearer) being in water, as well as methods and systems which provide for both water safety and water supervision functionality.

In one aspect, the wearable device comprises a transmitter for transmitting a signal that is detectable by a remote device configured to cause an alarm if the signal is indicative of the device being immersed in water, and an interchangeable visual feature.

In another aspect, the wearable device comprises a sensor for sensing immersion of the device in water, a transmitter for transmitting a signal when the device is immersed in water, the signal being detectable by a remote device configured to cause an alarm upon detection of the signal and an interchangeable visual feature.

The wearable devices of the present invention provide a water safety alarm and supervision aid for the parents of children, the carers of intellectually impaired people, the owners of pets and any other person who may want to be immediately informed should the wearer of the device come into contact with water.

There is also provided a repeater device arranged to receive the transmitted signal of the wearable device, amplify the signal, and re-transmit the signal. In other words, the repeater device extends the range of the signal transmitted by the wearable device.

There is also provided a base station, arranged to receive transmitted signals from a plurality of wearable devices. The base device is capable of providing visual and auditory indications (i.e. "alarms") to alert a person standing near the base device.

There is also provided a methodology or protocol for escalating the transmission of an alarm signal until such time as a third-party acknowledges receipt of the alarm signal.

In another aspect, there is provided an electronic method for monitoring a wearable device, the device being in communication with a receiving device, comprising the steps of, transmitting, from the wearable device via a wireless communications protocol, an encoded signal capable of being received by the receiving device, the encoded signal including information identifying the wearable device and information regarding the status of the device, wherein, upon receipt of the encoded signal, the receiving device decodes the signal, and dependent on the received information regarding the status of the wearable device, the receiving device performs one or more of sending a broadcast signal including the encoded signal via a transceiver, sending the encoded signal to a second receiving device via a wireless communications network, sending an alarm signal to a second device and sounding an alarm.

In one embodiment, the receiving device includes the further step of, upon not receiving an encoded signal within a predetermined time, sending an alarm signal to a second device, whereby, optionally, the receiving device is capable of receiving an acknowledgement signal from the second device, whereby, upon not receiving an acknowledgement signal within a predetermined time, the receiving device performs the further step of resending the alarm signal to the second device.

In one embodiment, the step of sounding an alarm includes the steps of sounding at least one of an audible alarm and a visual alarm.

In one embodiment, the receiving device includes a transceiver capable of performing the further step of sending a command signal to one or more of the wearable device and the second receiving device, the command signal including information arranged to alter information in the wearable device and the second receiving device.

In one embodiment, at least one of the receiving device and the second receiving device is one of a repeater unit and a mobile computing system.

The main application the inventor envisages for this device is for the supervision of children, and the device, repeater and base station, and associated methodology will therefore be described below primarily in this context.

As noted above, wearable devices which cause an alarm when they are immersed in water are known. Such devices, however, are not particularly aesthetically pleasing, may be uncomfortable to wear or considered to be unfashionable by the wearer. Compliance in wearing such devices at all relevant times may therefore be difficult for a parent to maintain. The inventor realised that, in order to be as effective as possible, the device must be worn at all times and that, in order for the device to be worn at all times, it must be aesthetically pleasing to the wearer. In effect, the device should be thought of more as a piece of jewellery or an adornment by the wearer.

The wearable device of the present invention therefore includes a visual feature. The visual feature may be provided in any form that is aesthetically pleasing to the wearer of the device. As the device is intended for use over an extended period of time, and noting that the tastes of the wear would usually be expected to change over time, the visual feature is interchangeable in order to maintain the aesthetically pleasing nature of the device for its useful life. For example, the tastes of a toddler (at which age the device should probably start being worn) would differ from the tastes of a 4-year old, which would differ from the tastes of a 6-year old (after which time a child may no longer require such close supervision). Visual features can be provided appealing to each of these age groups.

Typically, the interchangeable visual feature will include indicia, for example, indicia which is visually attractive to children (i.e. in embodiments of the device intended to be worn by children). By way of example only, such indicia may include characters from recent movies, band members from the Wiggles, animals, mythical creatures, emoji, etc. Photographs of loved ones may also be provided on the visual feature. As would be appreciated, hundreds (thousands) of different interchangeable visual features may be provided to cater for the tastes of even the most fussy of wearers.

In alternative embodiments, the interchangeable visual features may include textural features which are aesthetically pleasing to the wearer, such as engraved patterns to name but one example.

The interchangeable visual feature may be associated with the wearable device in any suitable manner. Typically, the interchangeable visual feature is configured to be releasably attachable to the device so that it can relatively easily be attached to and removed from the device at the wearer's pleasure. Any suitable mechanism via which the visual feature can be releasably fastenable to the wearable device may be used, examples of which include snap-fittings, screw fittings, slide fittings, etc.

The interchangeable visual feature may, for example, comprise a cover, cap or lid for the device or a portion of the device. Such a cover may, for example, be configured to be releasably fastenable to a body of the device. In one form, for example, the wearable device's body may have a cylindrical shape with sidewalls that include threads. In such a form, the visual feature can be screwed onto and off the body using a conventional screwing action. Specific embodiments of such a wearable device will be described in further detail below.

As discussed above, the wearable device of the present invention should ideally be permanently worn in order to be most effective. In the context of the present invention, it is to be understood that phrases such as "permanently worn", "worn all of the time", and the like, do not require that the device can never be removed, but that the device is intended to be worn for a majority of the time. Drownings can occur at any time and even under relatively close supervision, should a parent or carer be distracted for only a short period.

Whilst currently available devices are often too bulky or uncomfortable to be worn all of the time and need to be taken off overnight or when in "Safe environments" such as inside a house, the device of the present invention is typically intended to be comfortably worn at all times. Indeed, wearing of the device during a child's bath time may be advantageous because it will provide a daily test of the device. If the alarm does not sound whilst the child is in the bath, then the parent or carer will realise that something is wrong with the device.

The wearable device of the present invention may be configured to be worn at any appropriate location on the wearer's body. The device may, for example, be configured for wearing on the ankle, wrist or neck of a person, these being appendages often adorned with jewellery. Typically, the device would be configured to fit around a limb of a wearer, such as their wrist or ankle (noting that young should probably not have items around their necks at all times, for example when sleeping during the day).

In such embodiments, the wearable device may comprise a band configured to fit around the wearer's limb. The band may be fit to the wearer's limb using any suitable fastening mechanism, or may be stretchable in order to fit around the limb of the wearer. In some embodiments, for example, the band may be formed from an elastically deformable material. In some of such embodiments, the force required to stretch the band before it can be removed from the limb of the wearer may be such that it hinders, discourages, stops or even prevents it from being removed by a child.

The wearable device of the present invention may include a sensor for sensing immersion of the device in water. Any sensor having appropriate characteristics (e.g. size, weight, responsiveness to immersion in water, etc.) for use in the invention as described herein may be used.

In some embodiments, the sensor for sensing immersion of the device in water may comprise a material which expands upon contact with water. Any material that will expand quickly upon exposure to water and which will contract when no longer exposed to water should be suitable for use in the present invention.

For example, hydromorphic polymers and superabsorbent polymers are classes of polymers that expand on contact with water and contract when no longer in contact with the water. Some of these polymers can, for example, expand up to five times their original size upon exposure to water. Polymers such as sodium polyacrylate, for example, are superabsorbent polymers which expand upon exposure to water.

In some of these embodiments, the device may include a chamber containing the material which expands upon contact with water and which is in fluid communication with an exterior of the device. Swelling of the material in the chamber can cause a mechanical change which, in turn, activates the transmitter and causes it to transmit its signal. Factors such as the volume of the chamber, the pressure at which the material is stored and the physical forces externally applied to the chamber can be controlled in order for the transmitter to be actuated even when only a small expansion occurs. A specific embodiment of this mechanism will be described in further detail below.

Alternatively, the sensor for sensing immersion of the device in water may comprise a water sensor circuit. Water sensor circuits are known in the art and can be selected according to factors such as the desired sensitivity, water type (e.g. salt water or fresh water) and power requirements.

In its simplest form, water sensor circuits include two sensor wires which are configured such that, when immersed in water, an electrical circuit is completed and the transmitter caused to transmit its signal. Sensor wires having more complicated configurations may be provided if such would be advantageous (e.g. if extra sensitivity is required).

Water sensor circuits may advantageously be faster to respond to immersion into and removal from water and may have greater sensitivity and a longer lifespan than devices which are chemically actuated. Disadvantageously, water sensor circuits require power to operate and will therefore be an additional drain on the device's battery.

In some embodiments, the wearable device of the present invention may include two (or more) sensors for sensing immersion of the device in water, where such might be advantageous.

In the second aspect of the present invention, the wearable device comprises a transmitter for transmitting a signal that is detectable by a remote device configured to cause an alarm if the signal is indicative of the device being immersed in water. The transmitter may, for example, be configured to transmit a signal which is attenuated (e.g. reduced in intensity or blocked entirely) when the device is immersed in water, whereby the attenuated signal is indicative of the device being immersed in water and causes the alarm. In the second aspect of the present invention, the wearable device includes a transmitter that transmits a signal when the device is immersed in water (e.g. when the sensor senses this condition).

Any transmitter having a size and functionality consistent with the invention as described herein may be used. The inventor expects that a transmitter (including its associated componentry) having a size of about 20 mm×5 mm is achievable. The transmitter may transmit the signal using any suitable communications protocol or wireless network, provided that the signal (or its attenuation) is highly likely to be received by the remote device (noting that all communications protocols have range restrictions). Examples of communications protocols or networks which might be utilised by the present invention include cellular networks, wireless networks (e.g. a home wireless network), Bluetooth®, etc. One example of a transmitter which should be suitable for use in the device of the present invention is a LORA 915 MHz transceiver. Information regarding LORA may be found at, for example, https://en.wikipedia.org/wiki/LoRa.

In one embodiment, the device includes an 8 bit microcontroller, a LORA 900 MHz transceiver, a LiPo (Lithium-ion Polymer) charging integrated circuit and an antenna for the 900 MHz transceiver. Additionally, there are provided contacts for the water sensor and an additional contact internally for the pressure activated switch. The microcontroller monitors all alarm inputs on interrupt driven events, utilising a low current sleep mode which wakes up when activated. Additionally, the microcontroller wakes the transceiver up periodically to transmit a message, which is commonly 2 or 3 bytes of data containing the device ID, the device status and a checksum.

The message signal may be received by a repeater or base station unit (described in more detail below). The message signal acts as a failsafe mechanism, such that if the message is not received by the repeater or base station on a regular basis, the repeater or base station may itself be arranged to sound an alarm.

The failure to send the message signal (or receive the message signal) could be due to reasons not connected to the safety of the child, such as the water absorbing the transmission signal of the device, the child having gone outside the range of the repeater or base station, or the device failing (e.g. flat battery or electronic error). Again, given the potential consequences, the risk of such "False alarms" are deemed acceptable.

The device, in one embodiment, also includes an additional internal inertia sensor arranged to detect movement. Where the child removes the device, it will sound an alarm after a given amount of time of no movement. The device also monitors battery level and will alert when the battery level is low.

The wearable device of the present invention may also include other components either necessary to achieve the functionality described herein or which can impart further advantages.

For example, the wearable device will require a power source for at least the transmitter. Such a power source may be rechargeable so that it is not necessary to replace batteries periodically. Preferably such a rechargeable power source can be wirelessly recharged, so that the device does not need to include sockets for charging cables or the like. However, replaceable batteries (e.g. a 3.7V button cell battery) may be used with the device and would likely allow for simpler electrical circuitry to be used. As will be described below, the wearable devices can be dismantled relatively easily when it is necessary to replace the battery.

The wearable device may also include any type of antenna for use with the transmitter to transmit the signal, as may be desired for any particular application. For example, different antenna designs may be suitable for different locations. In built up or indoor areas, depending on the protocol utilised, an antenna designed for transmission over a protocol such as WiFi or Bluetooth may be utilised. Alternatively, in an embodiment specifically made for outdoor use where third party networks are utilised, antennas designed for the 3G or 4G frequency bands may be utilised. It will be understood that any suitable antenna may be used, depending on the requirements and application of the embodiment.

The signal transmitted by the transmitter is detectable by a remote device configured to cause an alarm upon detection of the signal. Any suitable remote device capable of detecting the signal and causing an alarm may be used in the present invention. In some embodiments, for example, the remote device may be a mobile computing device running an appropriate software application. The computing device includes any device capable of receiving a signal and utilising software or hardware to provide an alarm, such as a smartphone, a tablet computing system, or a dedicated hardware device such as a "base station". The remote device, particularly where the remote device is a dedicated hardware device such as a base station, may include a portable siren which can be taken to potentially dangerous locations such as friends' pools, beaches, swimming holes, etc.

In some embodiments, the remote device may include an intermediate or repeater unit which detects the signal (or its attenuation) from the wearable device and subsequently transmits information indicative of the device being immersed in water to a further device or devices in order to cause an alarm on those devices (e.g. the intermediate unit functions as a repeater station). Such an intermediate or repeater unit could be conveniently positioned in a house (e.g. in a central location in the house such as the kitchen or underneath the eave of a house, close to potentially dangerous locations such as a swimming pool) and may be used to detect even relatively weak signals from the device (which may enable the transmitter to lower the drain on the device's power source). In one embodiment, where the intermediate or repeater unit is portable, it can be taken with the wearer to potentially dangerous locations, as described above, thus providing the water safety and supervision aid features of the present invention even in remote locations.

Such an intermediate unit may advantageously enable the wearable device to emit only a relatively weak signal, with the device being capable of amplifying that signal and/or transmitting the signal using other communications protocols in order to activate the alarm. For example, the transmitter may be paired with an intermediate unit via a low power Bluetooth® connection, or the like, with the intermediate unit including a SIM card such that it is able to send signals to designated mobile device(s) via a cellular network, for example. The intermediate unit may also be configured for sending signals to designated mobile devices via other communications protocols, e.g. via wireless or Bluetooth® connections, in the event of no cellular signal being present.

The alarm would typically be an audible alarm, this being the most likely to attract the attention of the wearer's parent or guardian. However, other forms of alarm (e.g. vibration, flashing lights, etc.) could be used instead of or in addition to the audible alarm. In the event of the volume of the remote device being turned off or down, then the alarm should include turning up the volume (possibly in a staged manner) so that the alarm can be heard.

In embodiments of the invention which include an intermediate or repeater unit, as described above, the intermediate unit may also be configured to sound an alarm. Given the potential consequences and need for rapid action in the event of immersion, alarms coming from multiple sources may provide an additional safeguard and are thus considered to be appropriate. The repeater unit simply acts as a repeater on the 900 MHz LORA channel. The repeater device has, in one embodiment, an internal battery charged via a solar panel. It also sends a signal if the battery of the repeater is low.

The repeater re-transmits the status packet from the wearable device. As with the signal from the wearable device, if the base station fails to receive the repeater device signal, the base station will sound an alarm. The repeater is also monitored with its own status packet as often the pendant may be inside and the outside unit will not detect a signal, but the base station is still informed if the repeater device is working.

There is also provided a base station which has a LORA 900 MHz transceiver, a Bluetooth and WiFi transceiver, an LCD screen, a speaker and a keypad, plus an internal LiPo battery and charger and an external power input (via a 2 amp, 5 v plug pack).

The base station monitors external signals from both the wearable device and the repeater device. An internal 32 bit ARM processor utilises the Bluetooth transceiver to link with a remote computing device, which in the embodiment, includes an "app" (software application capable of interfacing with the base station via the Bluetooth connection).

The app relays alarms if in range and also allows the user to set different parameters on the wearable device and to set WiFi linking between the base station and the repeater unit. Moreover, the WiFi can connect to another WiFi network (such as a home network), to thereby allow information to be sent beyond the immediate network formed by the wearable device, repeater unit, base station and mobile computing device, such that monitoring may occur via any remote device capable of connecting to the network.

Returning to the base station, the provided LCD screen and keypad act as a user interface in the event that the base station is not accessible via a mobile computing device, The interface provides the status of one or more wearable device, one or more repeater are shown units, the battery voltage of each one of the wearable devices and repeater units, the base station battery voltage and also allows for the setting of various parameters, such as the audio alarm level.

In some embodiments, the alarm may comprise an alarm protocol, that is, a cascading system of alarms which are activated depending on the definition of the protocol. Examples of some alarm protocols will be described herein, although variations of these and possibly more suited to specific circumstances will immediately be apparent. Alarm protocols would typically be better suited for use with remote devices such as mobile computing devices (where the alarm protocol may be embodied in or operated by a software application on the mobile computing device), although this need not always be the case.

In some embodiments, the alarm protocol may include two or more remote devices. In such embodiments, the alarm protocol may be embodied in a software application running on the mobile computing devices.

A specific alarm protocol involving primary and secondary mobile computing devices in the form of mobile telephones will now be generally described. Immediately upon detecting the signal from the wearable device, which is indicative of the wearer (e.g. a child) being in contact with water, an alarm on the primary mobile device is activated. The primary carer is thereby warned that the child may be in contact with water and prompted to immediately investigate. It may be that the child is simply washing their hands, playing with a hose, or the like, in which case the primary carer can simply cancel the alarm.

In the event of the alarm on the primary mobile computing device not being cancelled within a predetermined time, then the alarm protocol may include causing an alarm on one or more secondary mobile computing devices to be activated. Thus, should the primary carer for any reason not be able to investigate, secondary carers are notified relatively quickly. The secondary carers may, for example, be next-door neighbours, spouses or other people who are relatively likely to be able to investigate the location of the child, or contact the primary carer by other means (e.g. a landline telephone or by knocking at the door). The secondary mobile computing device might also be another device present in the house, lest the primary carer not be in immediate possession of the primary mobile device or the battery on the primary mobile device have run out, etc.

The predetermined time can be selected by the primary carer (e.g. via the software application on their mobile device) to suit their specific circumstances, but should be no longer than 1-2 minutes, given the possible seriousness of the situation.

The alarm protocol may also provide a supervisory function by repeating the alarm on the primary mobile computing device if the wearable device is still immersed in water a predetermined time after the preceding alarm was cancelled. Thus, the primary carer is reminded at periodic intervals of the potentially dangerous situation the child is in. Such repeating reminders may be useful in the event of the primary carer having to answer the door, attend to other urgent domestic chores, etc. This predetermined time can also be selected by the primary carer (e.g. via the software application on their mobile device) to suit their specific circumstances, but should be no longer than 2 minutes, given that drowning can occur rapidly.

Again, if this alarm is not cancelled, the alarm protocol may cause an alarm on the secondary mobile computing device(s).

Whilst the recurring nature of the alarm on the primary mobile device might become annoying should the child be immersed in water over an extended period of time (e.g. whilst having a bath or playing in a pool), such an inconvenience is considered to be appropriate given the potential consequences of inattention.

The alarm protocol described above would continue until such time as the signal indicative of the device being immersed in water is no longer being transmitted by the transmitter, or until the signal being transmitted is no longer attenuated because of the device being immersed in water.

Figure 1B:
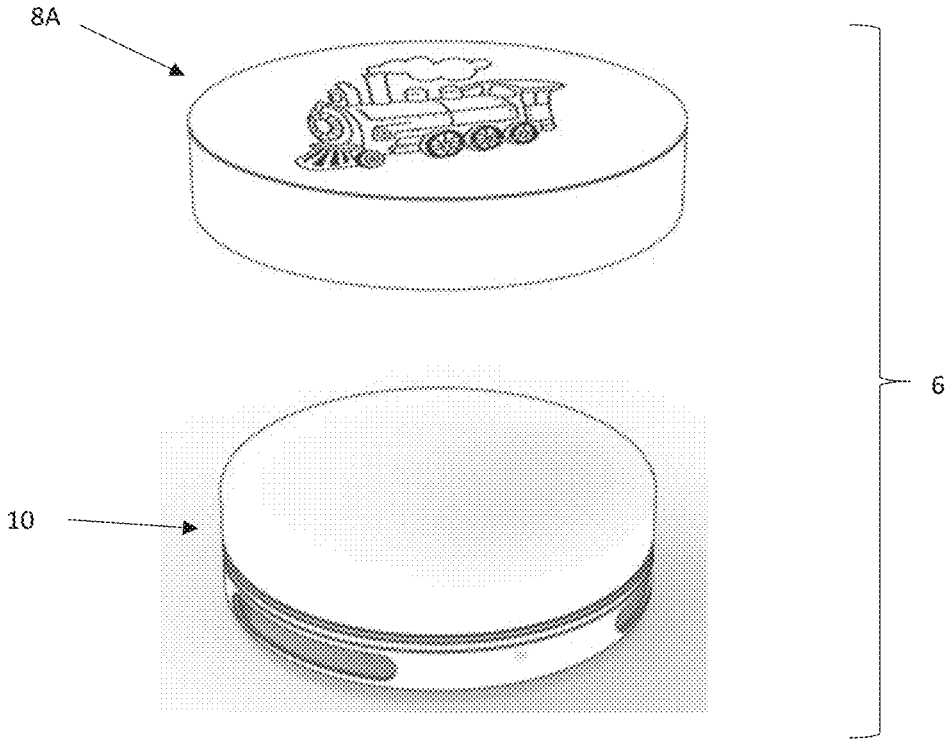
FIG. 1B shows an interchangeable visual feature being attached to a body of a wearable device in accordance with an embodiment of the present invention.
Figure 2:
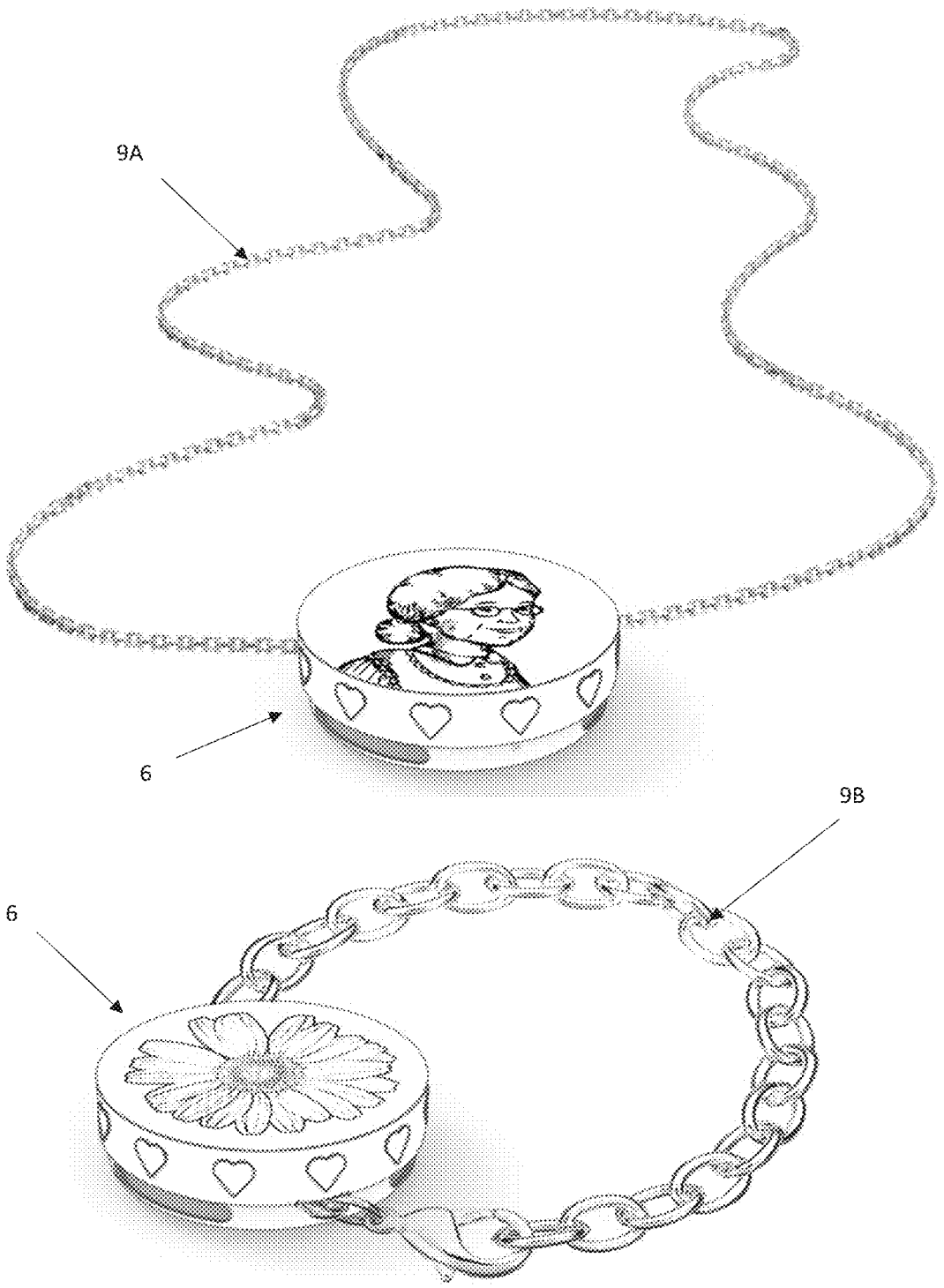
FIG. 2 shows wearable devices in accordance with embodiments of the present invention having different visual features and different means for attachment to a wearer.
Figure 3:
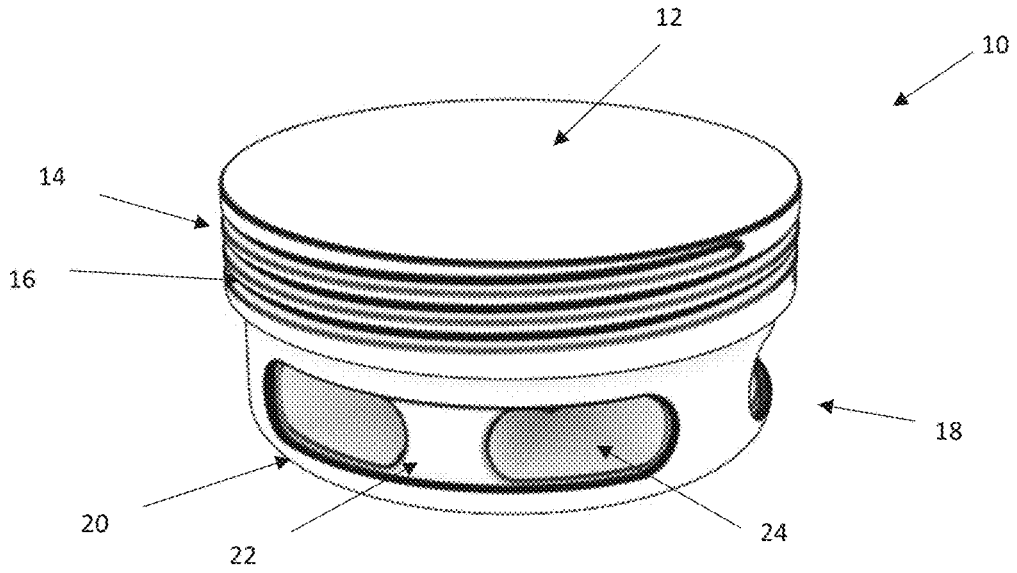
FIG. 3 shows a perspective view of a body of a wearable device in accordance with a first embodiment of the present invention.

Referring now to the accompanying drawings, specific embodiments of the wearable device of the present invention and components thereof will now be described. Referring firstly to FIGS. 1A, 1B and 2, a wearable device 6 in accordance with an embodiment of the present invention is shown having different visual elements in the form of caps 8A, 8B and 8C. Caps 8A, 8B and 8C have indicia printed on them (i.e. a train, a flower and a photograph of Grandma) which are intended to appeal to different children. As can be seen in FIG. 1B, cap 8A is configured to snap onto a body 10 of the device 6, and can be removed in the event of the wearer wanting to change the picture on the device.

As can be seen in FIG. 2, attachment means in the form of a neck chain 9A or wrist/ankle chain 9B can be affixed to the device 6 in order for it to be worn around a person's neck or wrist/ankle, respectively. As would be appreciated, chains 9A and 9B emphasise the visual appeal of the device 6, making it look more like a piece of jewellery and hence more likely to be worn all of the time.

Referring now to FIGS. 3 to 6, a body 10 of a wearable device in accordance with a first embodiment of the present invention is shown. Body 10 is generally cylindrically shaped, having a lid 12 with a circularly-shaped uppermost (in use) surface and sidewalls 14 which include an external thread 16 onto which a cap (not shown in FIGS. 3 to 6) can be screwed onto. Body 10 also has a base portion 18 which includes three elongate apertures, shown generally as slots 20 spaced therearound. Visible in FIG. 3 through the slots 20 is expandable disk 22, which includes a hydromorphic material 23 (see FIGS. 4 and 5). Expandable disk 22 has a number of water permeable windows 24 spaced around its sidewall, through which water can pass and thus make contact with the hydromorphic material 23, as will be discussed below. Water permeable windows 24 are formed from a material which will allow water to pass therethrough, but will not allow the hydromorphic material 23 to escape.

Figure 5:
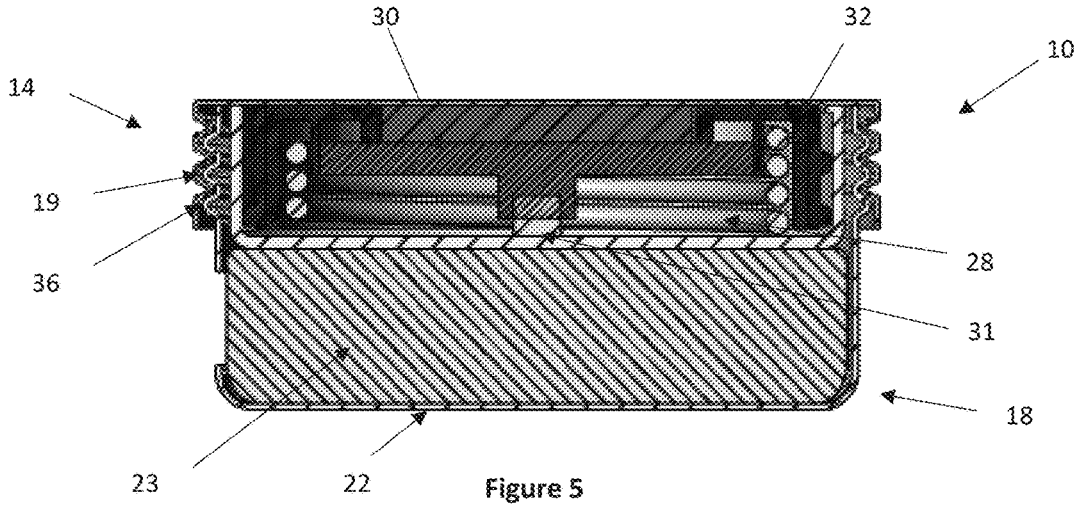
FIG. 5 shows a cross sectional view of the body of FIG. 3 in a wet state.
Figure 6:
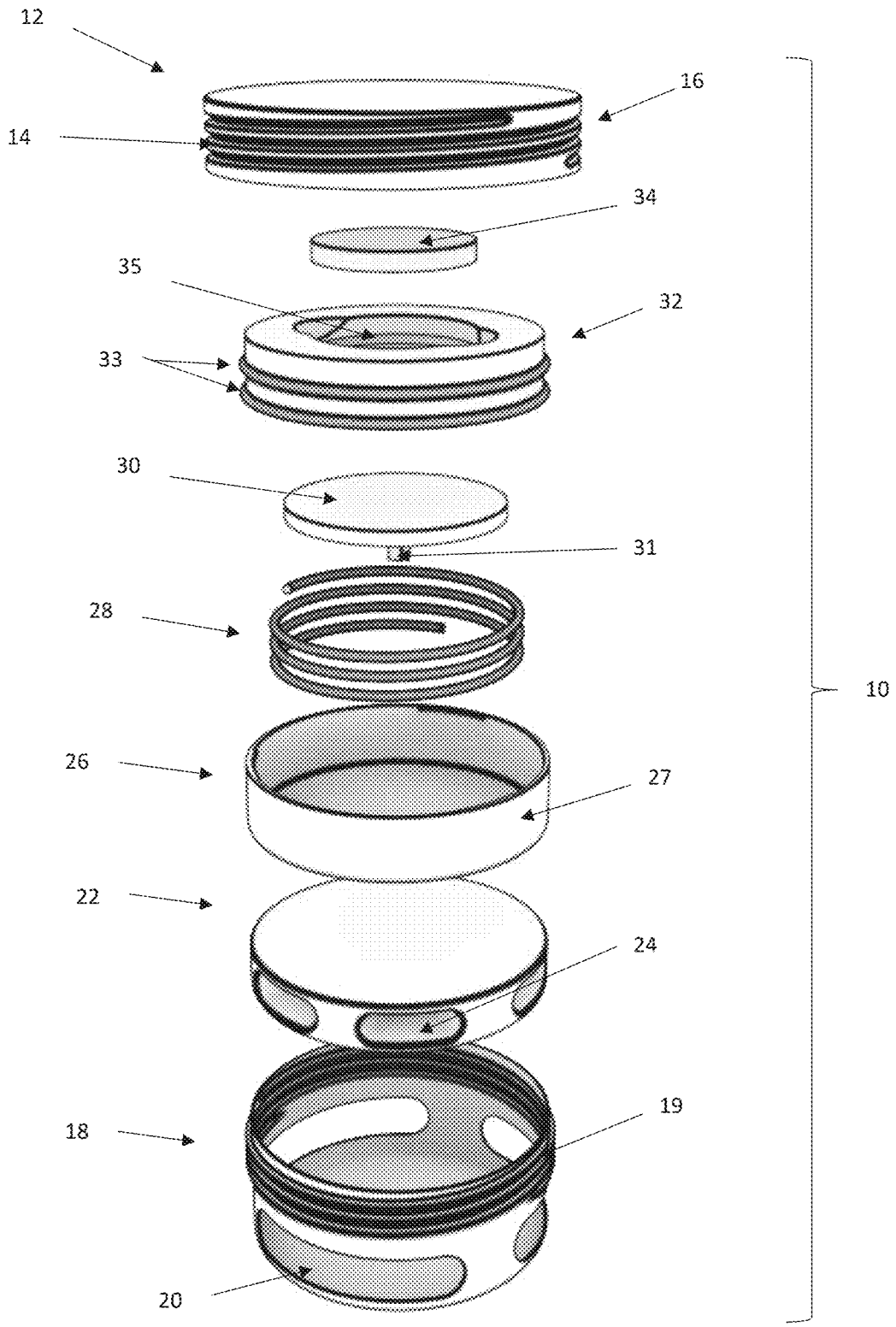
FIG. 6 shows an exploded view of the body of FIG. 3.
Figure 7:
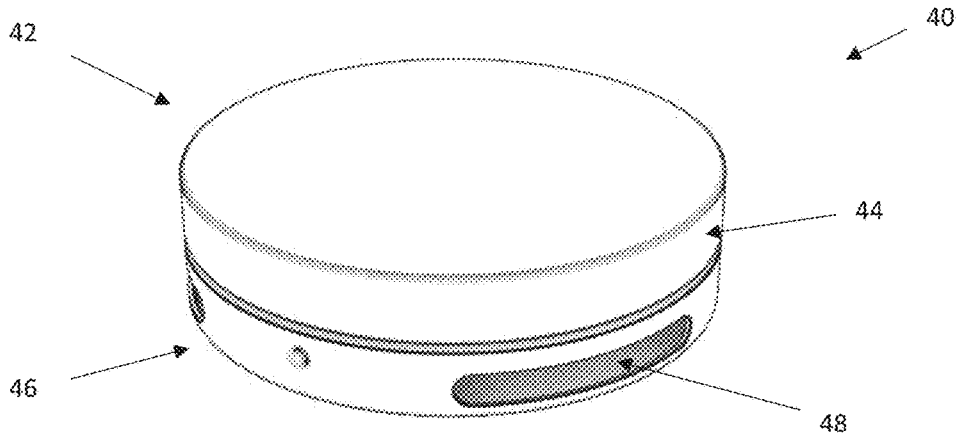
FIG. 7 shows a perspective view of a body of a wearable device in accordance with a second embodiment of the present invention.

Referring now to FIG. 6, all of the components of the body 10 can be seen in exploded form. At the top and bottom are the lid 12 and base 18, respectively, between which all of the other components of the body 10 are housed. As can be seen, the sidewalls of base 18 have a thread 19 provided on an upper portion thereof, and this thread can be matingly received by a thread 36 (see FIG. 5) on the inside of sidewalls 14. Screwing the base 18 and lid 12 together via threads 19 and 36 securely retains them together, with all components retained in their functional configurations therebetween.

The expandable disk 22 fits into the interior of the base 18, where its lower face is in contact with the floor of the base and its upper face is in contact with the bottom of a cup 26. Cup 26 has sidewalls 27 and retains therein a coil spring 28. A plate 30 which houses the electrical components (including the transmitter, not shown) having a button 31 on an underside thereof is positionable above the spring 28 and underneath a lid 32, the sidewalls of which include annular sealing members 33, 33 which are configured to sealingly engage with the sidewalls 27 of the cup 26 in order to protect the electrical componentry from the ingress of water. Finally, a battery is provided in the form of button cell battery 34, which is shaped to fit inside of the recess 35 on top of lid 32 and supply power to the electrical components of the device.

Figure 4:
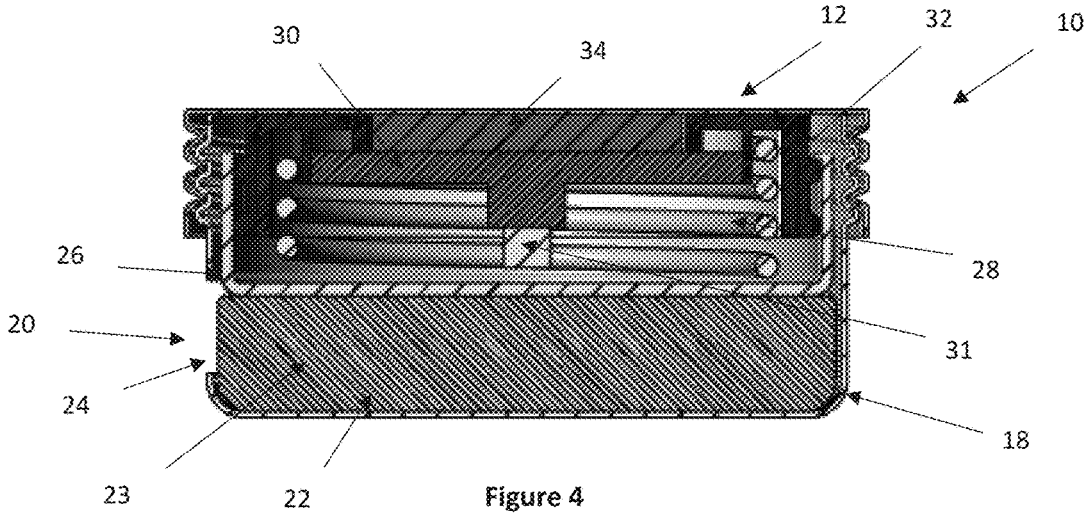
FIG. 4 shows a cross sectional view of the body of FIG. 3 in a dry state.

Operation of the device will now be described with reference to FIGS. 4 and 5, which show cross sectional views of the body 10 in dry and wet configurations, respectively. Referring firstly to FIG. 4, when dry the bias of spring 28 is strong enough to hold the cup 26 in a position with respect to the lid 32 whereby a clearance is provided underneath switch 31. When the body 10 is immersed in water, however, water makes contact with the hydromorphic material 23 (i.e. via slots 20 and water permeable windows 24) and it starts to expand. Expansion of the hydromorphic material 23 causes a width of the expandable disk 22 to increase, against the bias of the spring 28, which causes cup 26 to slide upwardly with respect to lid 32. As can be seen in FIG. 5, this movement causes switch 31 to be pressed which, in turn, activates an electrical circuit that causes the transmitter (not shown) to transmit a signal that is detectable by a remote device (e.g. a parent's mobile telephone, not shown) which is configured to cause an alarm upon detection of the signal. Upon removal of the body 10 from the water, the hydromorphic material 23 no longer swells and spring 28 helps to dewater it and cause the width of the expandable disk 22 to decrease and the cup 26 to slide downwardly with respect to lid 32. After only a small relative movement, the button 31 is released, causing the transmitter to stop transmitting its signal.

Referring now to FIGS. 7 to 11, a body of a wearable device in accordance with a second embodiment of the present invention is shown in the form of body 40. Body 40 is generally cylindrically shaped, having a circularly-shaped upper portion 42 having sidewalls 44. Body 40 also has a base portion 46 which includes two opposing elongate apertures, shown generally as slots 48. A visual feature in the form of a cover (not shown) is attachable to body 40 in the manner described above.

Figure 8:
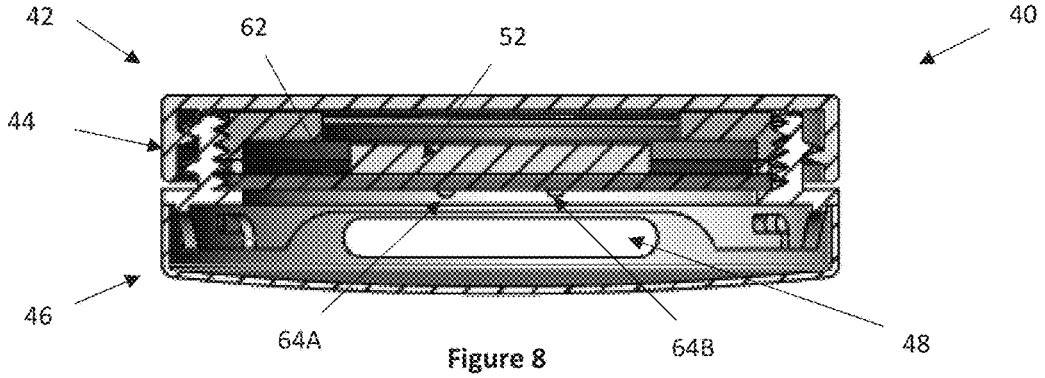
FIG. 8 shows a cross sectional view of the body of FIG. 7.
Figure 9:
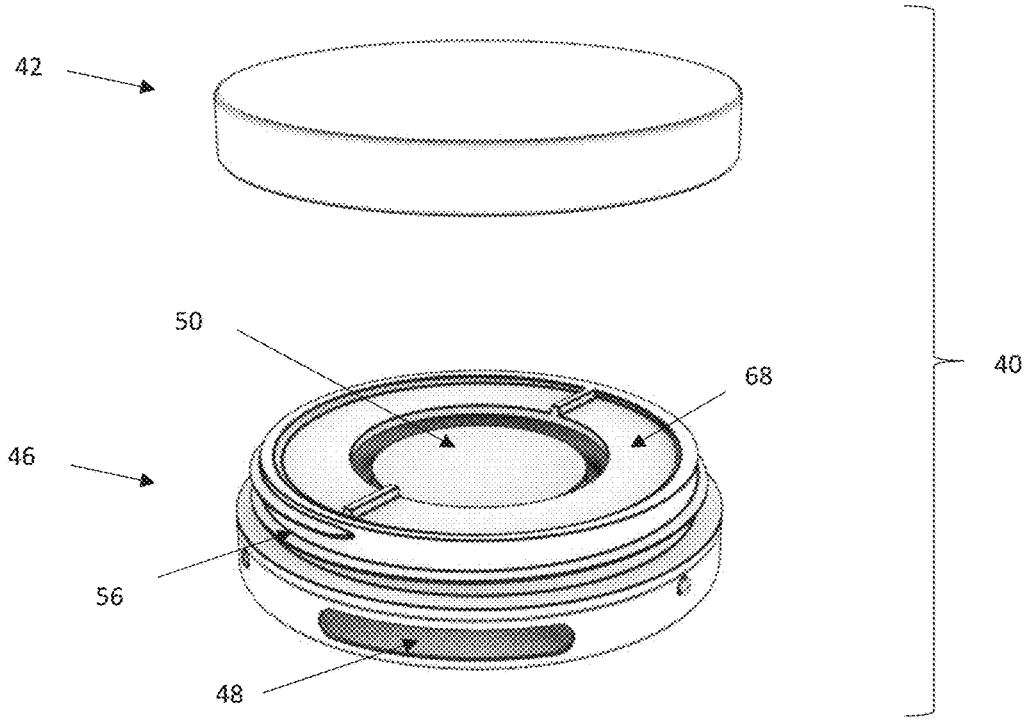
FIG. 9 shows a partially exploded view of the body of FIG. 7.

As can be seen in FIGS. 8 and 9, upper portion 42 includes threads which enables it to be screwed onto corresponding threads on the base portion 46 in order to securely join the portions. A recess 50 is provided in the base portion 46 for receiving a button cell battery 52 (see FIG. 11).

Figure 10:
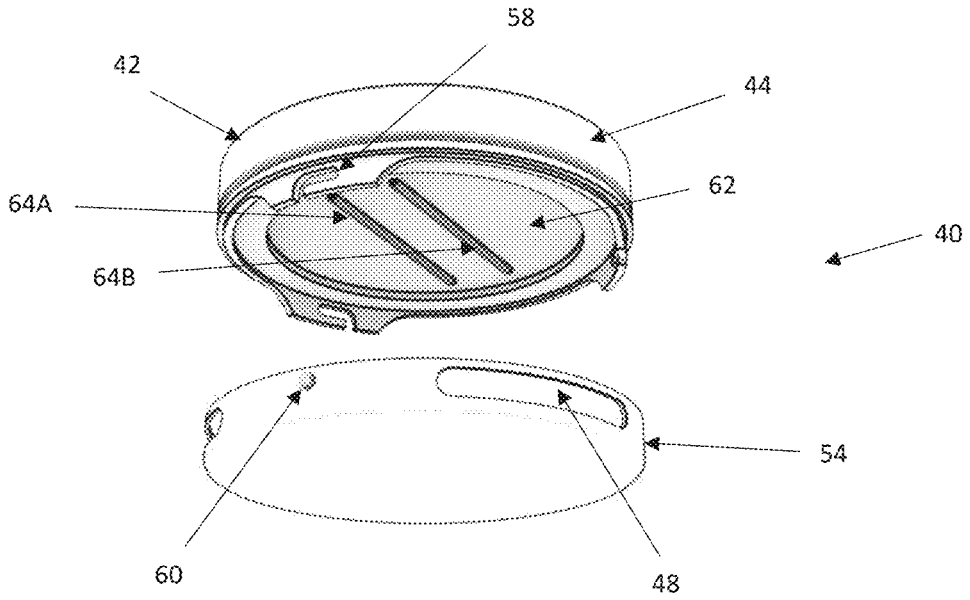
FIG. 10 shows another partially exploded view of the body of FIG. 7.
Figure 11:
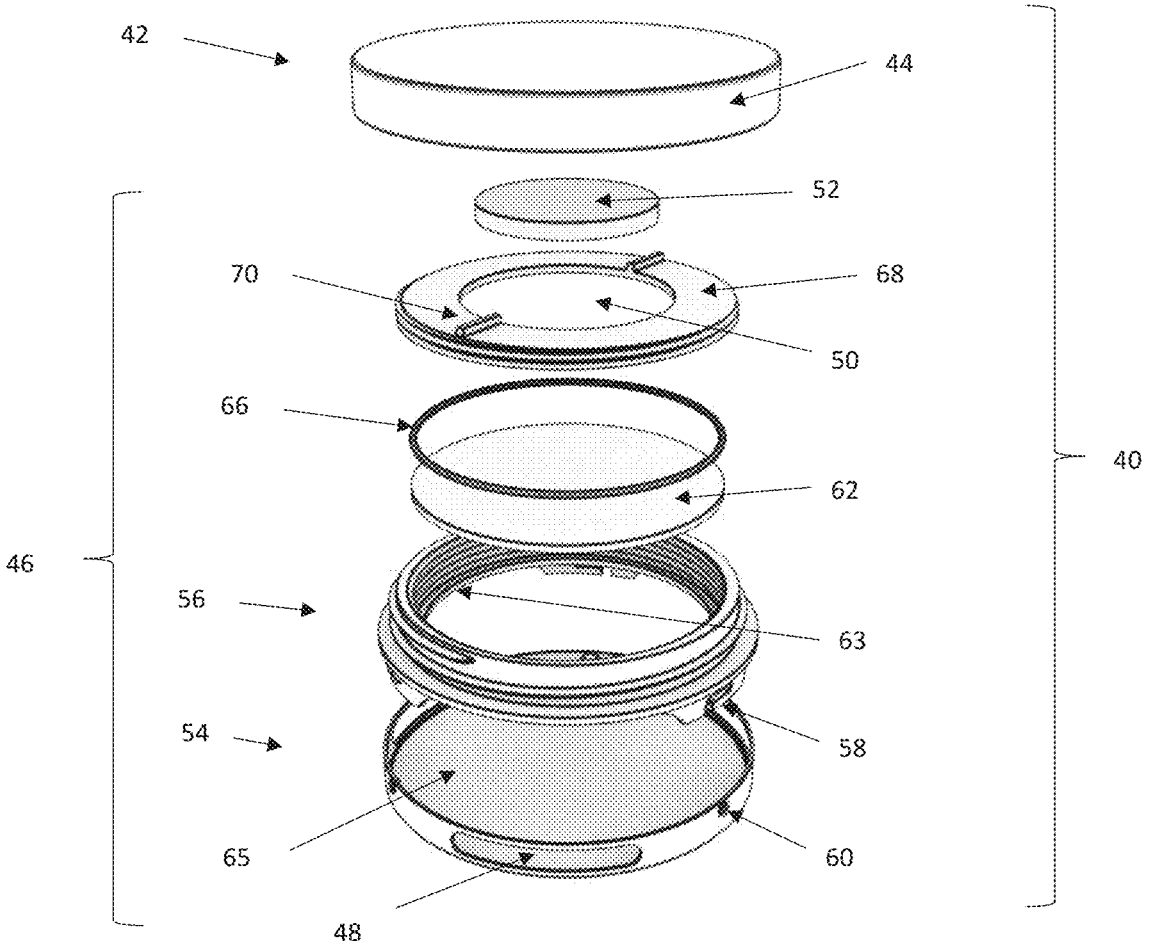
FIG. 11 shows an exploded view of the body of FIG. 7.

An exploded view of the body 40 is shown in FIG. 11. At the top of the Figure is the upper portion 42, with all the other components of the body 40 being housed in the lower portion 46. Lower portion 46 includes a base 54, in which the slots 48 are provided, and which is attachable to an annular housing 56 via a bayonet-type coupling 58, 60 (see also FIG. 10). A plate 62 which houses the electrical components (including the transmitter, not shown) is configured to be received within housing 56 and bear against its annular lip 63 in order to be retained therein. Lip 63 is formed of a material which provides a water-tight seal between the housing 56 and plate 62 in order to prevent the ingress of water.

Referring now to FIG. 10, two electrical wires 64A and 64B can be seen in a spaced arrangement on an underside of the plate 62. Electrical wires 64A and 64B are positioned in use in a chamber 65 in fluid communication with slots 48, 48. Immediately upon body 40 being immersed in water, water will enter the chamber 65 via slots 48, 48 and thus make contact with the electrical wires 64A and 64B. Once electrical wires 64A and 64B are in contact with water, a current can flow between them, which current completes an electrical circuit that causes the transmitter (not shown) to transmit a signal that is detectable by a remote device (e.g. a parent's mobile telephone, not shown) which is configured to cause an alarm upon detection of the signal.

Referring back to FIG. 11, an O-ring 66 is provided between the upper surface of the plate 62 and the screwable cap 68, again to prevent the ingress of water. Cap 68 has threads on its sidewalls which are threadably receivable into the corresponding threads of the housing 56 in order to securely hold housing 56, plate 62, O-ring 66 and cap 68 together in a watertight configuration. Raised tabs 70, 70 are provided on an upper surface of the cap 68 in order for a user to achieve a screwing action. As noted above, recess 50 is provided in the cap 68 for receiving a button cell battery 52.

Figure 12:
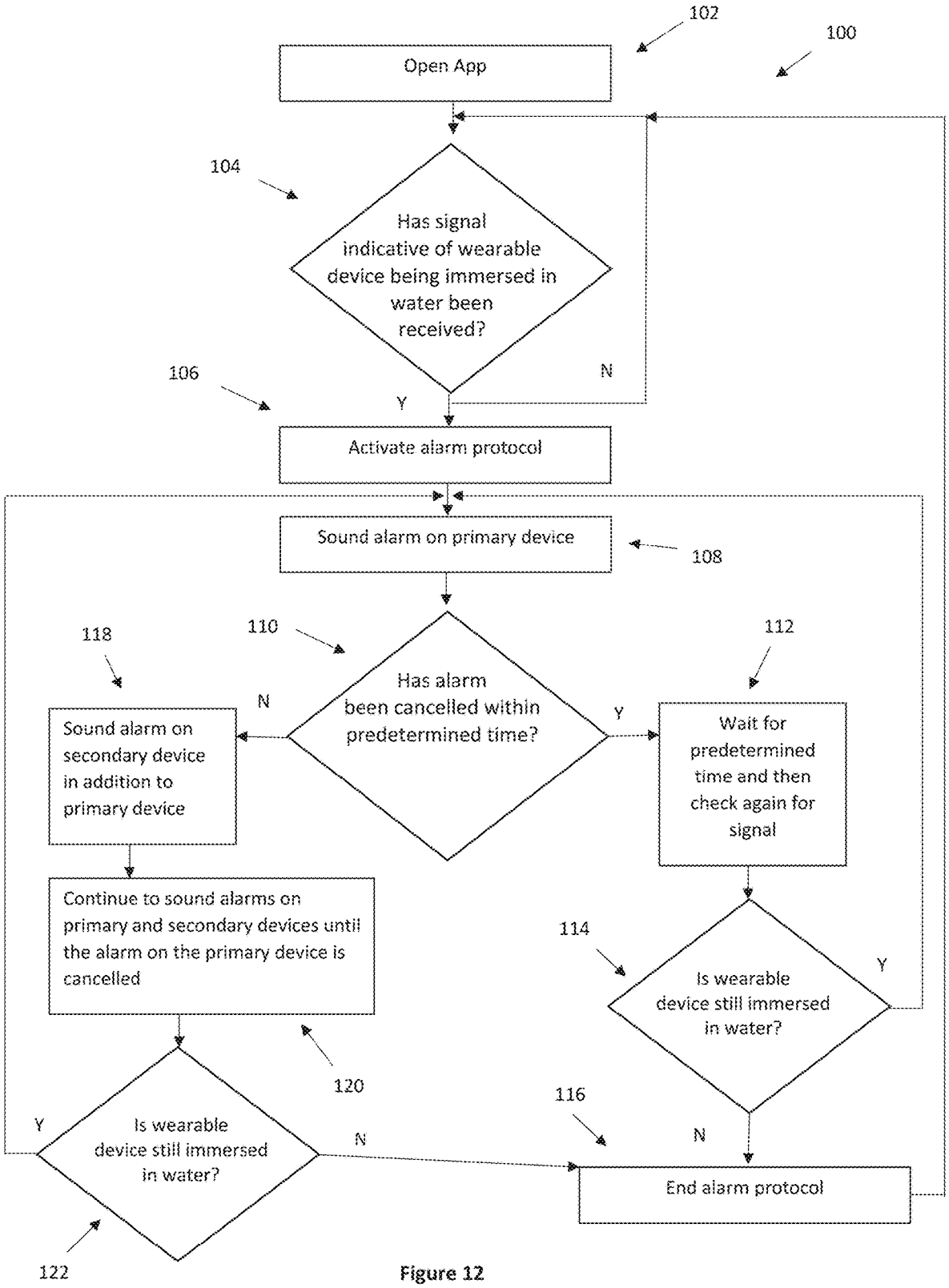
FIG. 12 shows a flowchart of an alarm protocol in accordance with an embodiment of the present invention.

In another aspect, the present invention provides an alarm protocol for use with a wearable device configured to transmit a signal when immersed in water. An example of one alarm protocol 100 is depicted in the flowchart of FIG. 12 and will be described below. The alarm protocol may be embodied in a software application configured to operate on a primary mobile computing device (e.g. a primary carer's mobile phone). In such cases, the software application is first opened 102 in the usual manner (e.g. by touching an icon on the screen of a mobile phone) and enters a standby mode. In other embodiments, the application may be caused to open automatically, for example, in the event of the wearable device detecting movement consistent with the wearer being awake.

Once open and in the standby mode, the alarm protocol comprises causing the mobile phone to check for a signal 104 from the wearable device (or from an intermediate unit, such as that described above, not shown), the signal being indicative of the device being immersed in water. In alternative embodiments (not shown in the flowchart), this check may instead be a check to see if a constant signal (e.g. a regular "ping") has been attenuated in any way or not been received, wither of which may be indicative of the wearable device being in water.

Upon receiving such a signal, the alarm protocol is activated 106 on the primary mobile computing device and an alarm is sounded 108. The alarm would likely be an audible alarm in order to gain the carer's attention as quickly as possible, even if they do not have their phone on their person, but may also (or instead) include other functions to attract the carer's attention. The alarm on the primary device must be cancelled within a predetermined time 110 (which is chosen by the user within certain parameters (e.g. a maximum time of 1-2 minutes) when setting up the application), which is indicative of the primary carer having located the wearer of the device and taken appropriate action.

If the alarm on the primary device is cancelled, then the alarm protocol waits for another predetermined time 112 (which can again be chosen by the user within certain parameters, e.g. a maximum time of 1-2 minutes) before again checking for the signal from the wearable device indicative of the device still being immersed in water 114. If the wearable device is no longer immersed in water, then the alarm protocol ends 116, and returns to the standby mode described above. However, if the wearable device is still immersed in water 114, then the alarm on the primary device is again caused to sound 108. In this manner, even though the carer is aware that the wearer is in water (i.e. because they cancelled the initial alarm), they are reminded at regular intervals of this, and thus prompted to re-check the wearer in the event of them having been distracted by something else.

If the alarm on the primary device is not cancelled within the (first) predetermined time, then an alarm is also sounded 118 on one or more secondary mobile computing devices (e.g. a neighbour's mobile phone or a secondary carer's mobile phone). The alarm sounding on the secondary device will prompt the device's owner to check in with the primary carer (e.g. by calling or visiting them), thereby providing a useful backup function in the event of the primary carer not having heard the primary alarm or being themselves incapacitated. The alarms on both devices would continue to sound 120 until cancelled by the primary device (or until a certain time period has passed). Once cancelled, the protocol comprises checking again for the signal from the wearable device indicative of the device still being immersed in water 122. If the wearable device is no longer immersed in water, then the alarm protocol ends 116 and returns to the standby mode described above. However, if the wearable device is still immersed in water, then the alarm on the primary device is again caused to sound 108.

Figure 13:
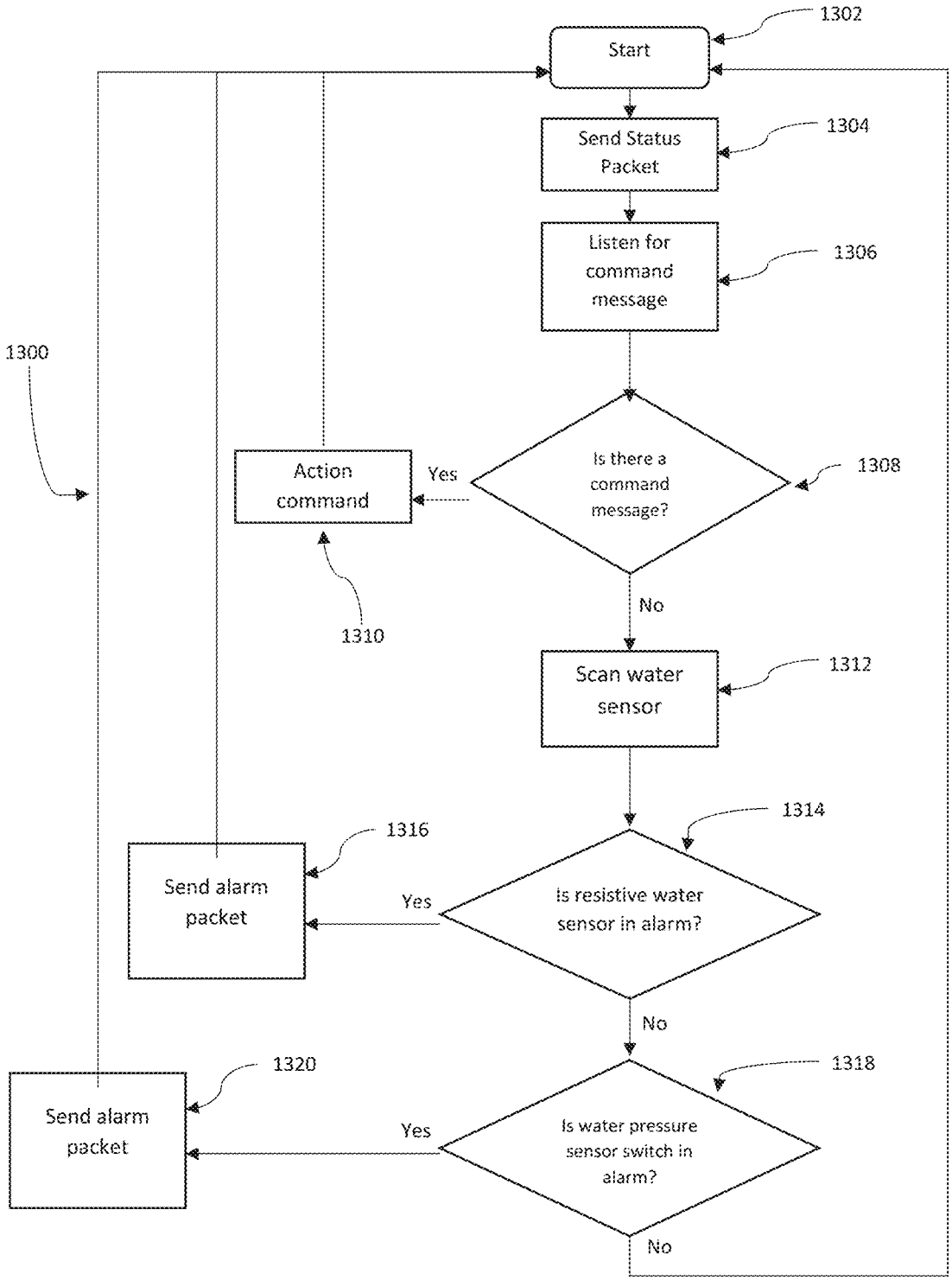
FIG. 13 shows an alternative flowchart of an alarm protocol in accordance with an embodiment of the present invention.

Referring now to FIG. 13, there is shown a process flow 1300 for a signal sent by a wearable device to a base station and/or a remote computing device, as previously described with reference to FIGS. 1 to 12. The process flow 1300, after being activated, initialised or "started" at step 1302, firstly sends via the transmitter of the wearable device a status packet (of information) at step 1304 via the transceiver, and subsequently, at step 1306, utilises the transceiver to listen for a command message received from a remote device (which may be a base station or a portable computing system). If the microprocessor of the wearable device identifies receipt of a command message (generally received from a base station or a remote computing device) at step 1308, the command message is actioned at step 1310, and the process flow returns to the start step 1302. If no command message is received at step 1308, the water sensor is scanned at step 1312 and a determination is made as to whether the resistive water sensor is registering an alarm condition at step 1314. If the resistive sensor is registering an alarm condition, then at step 1316 an alarm packet is transmitted by the transceiver to the base station or remote computing device, after which the process flow returns to start step 1312. If there is no alarm condition generated by the resistive water sensor at step 1314, the process continues to step 1318, where a determination is made as to whether the water pressure sensor is registering an alarm condition. If the water pressure sensor is registering an alarm condition, then at step 1320 an alarm packet is transmitted by the transceiver to the base station or remote computing device, after which the process flow returns to start step 1302. In this manner an alarm condition is communicated to remote devices such as a base station or a remote computing device.

Figure 14:
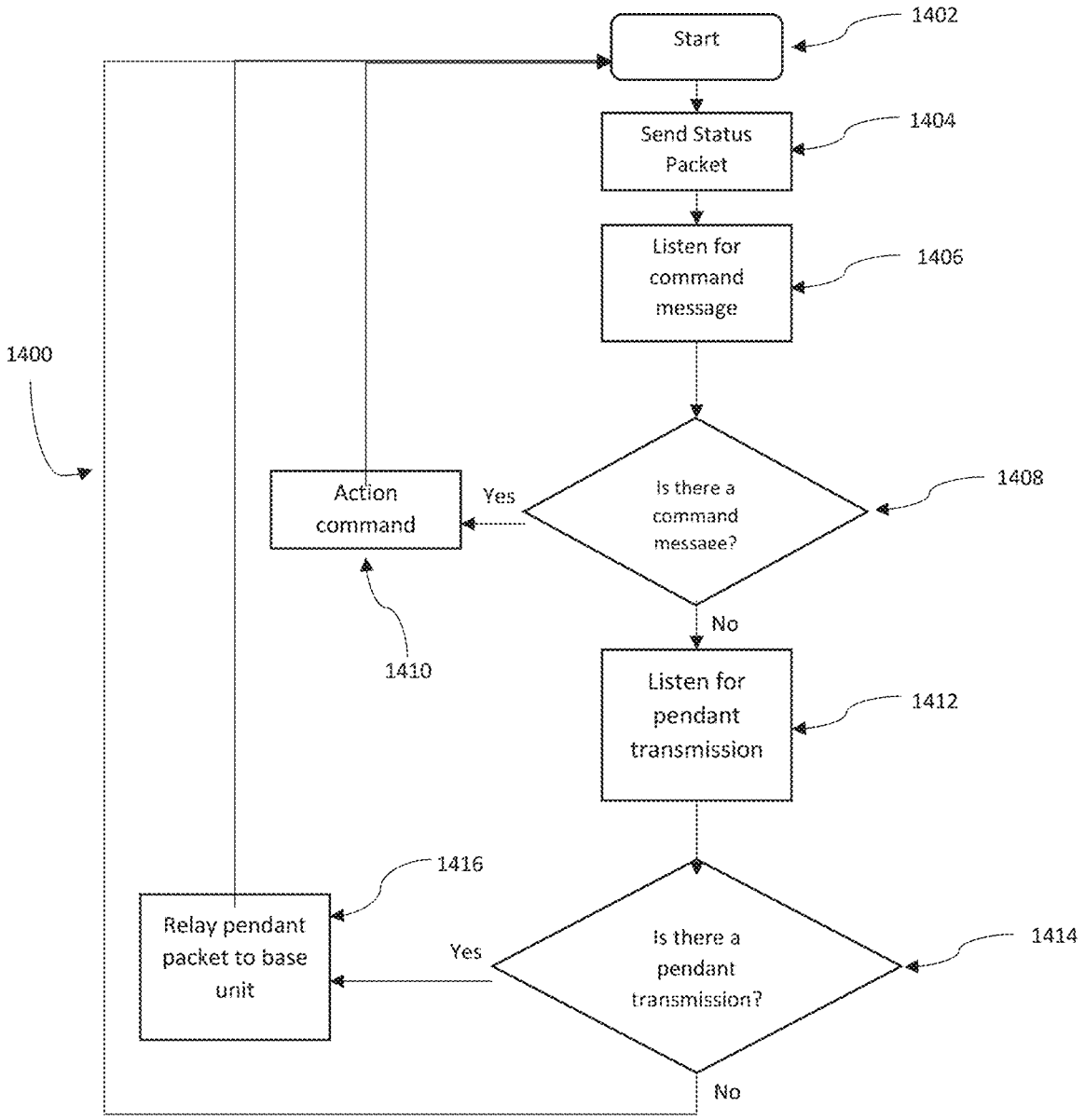
FIG. 14 shows a flowchart for a protocol utilised by a base station operating with a device in accordance with an embodiment of the present invention.

Referring now to FIG. 14, there is shown a process flow 1400 for a signal received from a wearable device (referred to in FIG. 14 as the "pendant") by a repeater unit, as previously described with reference to FIGS. 1 to 12. The process flow for the repeater device, after being activated, initialised or "started" at step 1402, firstly sends via the transmitter of the wearable device a status packet (of information) at step 1404 via the transceiver, and subsequently, at step 1406, utilises the transceiver to listen for a command message received from a remote device (which may be a base station or a portable computing system). If the microprocessor of the repeater unit identifies receipt of a command message (generally received from a base station or a remote computing device) at step 1408, the command message is actioned at step 1410, and the process flow returns to the start step 1402. If no command message is received at step 1408, the microcontroller waits for the repeater unit to relay a pendant transmission from the transceiver of the repeater unit at step 1412. If a pendant transmission is not received after a defined period of time at step 1414, the process flow returns to start step 1402. If, however, a pendant transmission message is received, then at step 1416, the pendant transmission message is re-broadcast ("relayed") by the transceiver of the repeater unit, so that it may be received by the base station, after which the process flow returns to start step 1402. In this manner, the repeater unit functions to "boost" or relay a pendant alarm (or other) signal to the base station.

Figure 15:
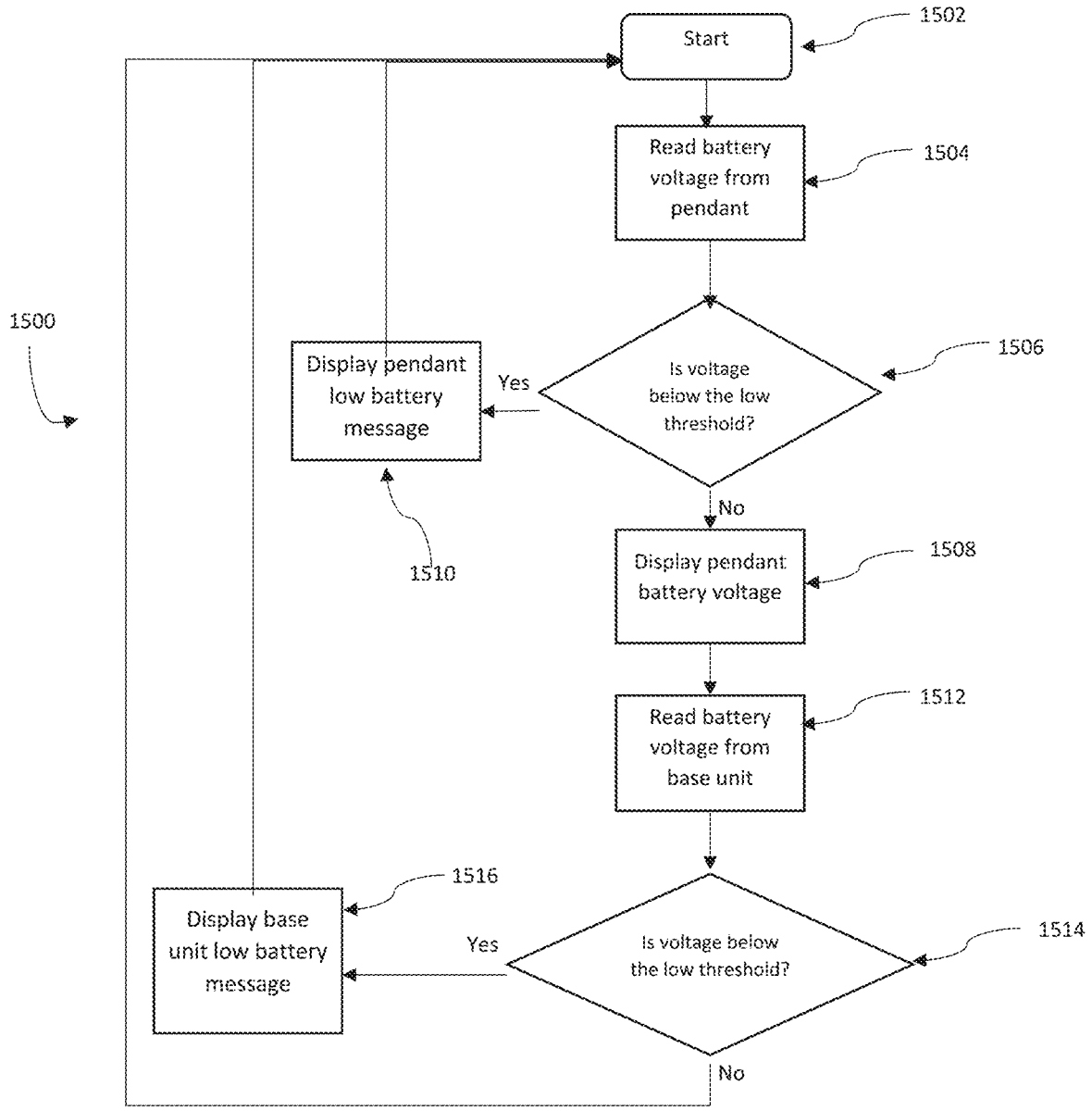
FIG. 15 shows a flowchart for a protocol utilised by a repeater unit operating with a device in accordance with an embodiment of the present invention.

Referring now to FIG. 15, there is shown a process flow 1500 for a battery testing process flow for the wearable device (pendant) and base station, which allows a user to receive feedback via the base station on whether a pendant and/or the base station has a low battery charge, which affects the ability of the pendant and/or the base station to correctly relay an alarm condition to a user. The process flow for the battery testing process, after being activated, initialised or "started" at step 1502, firstly reads the voltage from the pendant at step 1504, by either sending a command message via the transceiver on the base station to the pendant (such that the pendant can receive the command message and action the message accordingly as described in the process flow of FIG. 13), or, if the pendant is physically connected to the base station via a charging cradle, measuring the voltage directly from an internal circuit connected to the charging cradle and arranged to send a voltage reading to the microcontroller in the base station. Once the battery voltage of the pendant is received, a determination is made, at step 1506, as to whether the voltage is below an acceptable threshold. If so, the process continues to step 1510, where a pendant low battery warning message is displayed on the LCD screen of the base station, after which the process flow returns to start step 1502. If the battery voltage of the pendant is not below a threshold, the process proceeds to step 1508, at which the pendant battery voltage is displayed on the LCD screen of the base station. Thereafter, the battery voltage of the base station is read from an internal circuit connected from the base station battery and arranged to send a voltage reading to the microcontroller in the base station. Once the battery voltage of the base station is received, a determination is made, at step 1514, as to whether the voltage is below an acceptable threshold. If so, the process continues to step 1516, where a base station low battery warning message is displayed on the LCD screen of the base station, after which the process flow returns to start step 1502. If the battery voltage of the base station is not below an unacceptable threshold, the process returns to start step 1502.

Figure 16:
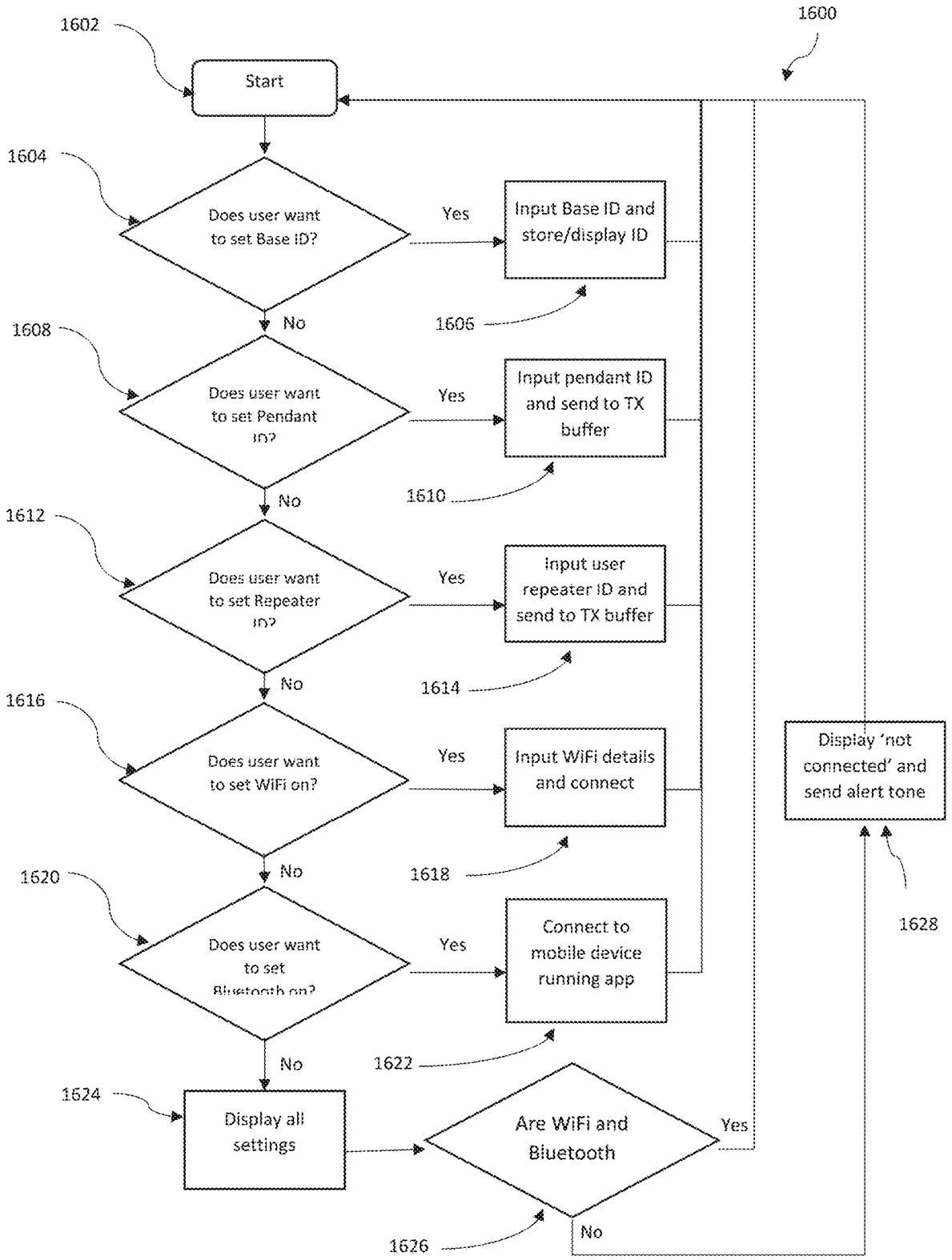
FIG. 16 shows a flowchart for a series of method steps for setting a base station in accordance with an embodiment of the present invention.

Referring now to FIG. 16, there is shown a process flow 1600 for the base station when a user wishes to set various parameters for the base station, repeater unit and/or wearable device (pendant). The process flow for the setting various parameters process, after being activated, initialised or "started" at step 1602, firstly determines whether the user wishes to set a new base station identifier (i.e. an unique alphanumeric string which can be used to identify the base station) at step 1604. If so, the microcontroller of the base station sets the base identifier by storing base identifier in memory or in a register of the microcontroller and displaying the base identifier on the LCD screen of the base station for manual verification by the user at step 1606, before returning to the start step 1602. If the user does not wish to set the base identifier, the process proceeds to step 1608, and determines whether the user wishes to set a new pendant identifier (i.e. an unique alphanumeric string which can be used to identify the pendant). If so, the microcontroller of the base station utilises the transceiver in the base station to send a command message (via a transmission buffer) to the pendant at step 1610, before returning to the start step 1602. If the user does not wish to set the pendant identifier, the process proceeds to step 1612, and determines whether the user wishes to set a new repeater identifier (i.e. an unique alphanumeric string which can be used to identify the repeater). If so, the microcontroller of the base station utilises the transceiver in the base station to send a command message (via a transmission buffer) to the repeater at step 1614, before returning to the start step 1602. If the user does not wish to set the repeater identifier, the process proceeds to step 1616, and determines whether the user wishes to switch on WiFi capabilities in the base station. If so, the microcontroller of the base station receives input information regarding the WiFi network and connects to the WiFi network at step 1618, before returning to the start step 1602. If the user does not wish to connect to a WiFI network, the process proceeds to step 1620, and determines whether the user wishes to switch on Bluetooth capabilities in the base station to allow connection to a mobile device running a software application as previously described in the specification. If so, the microcontroller of the base station receives input information and connects to the mobile device via a Bluetooth connection at step 1622, before returning to the start step 1602. If the process flow has passed through process steps 1604, 1608, 1612, 1616 and 1620 without setting any identifiers or connecting to any networks or devices, the process continues to step 1624, where all settings are displayed on the LCD screen prior to, at step 1626, a determination being made by the microcontroller as to whether the base station is connected to another device via a WiFi or Bluetooth connection. If so, the process returns to the start step 1602. If not, the process displays a "not connected" message on the LCD screen and sends an alert tone at step 1628, before the process returns to the start step 1602.

Figure 17:
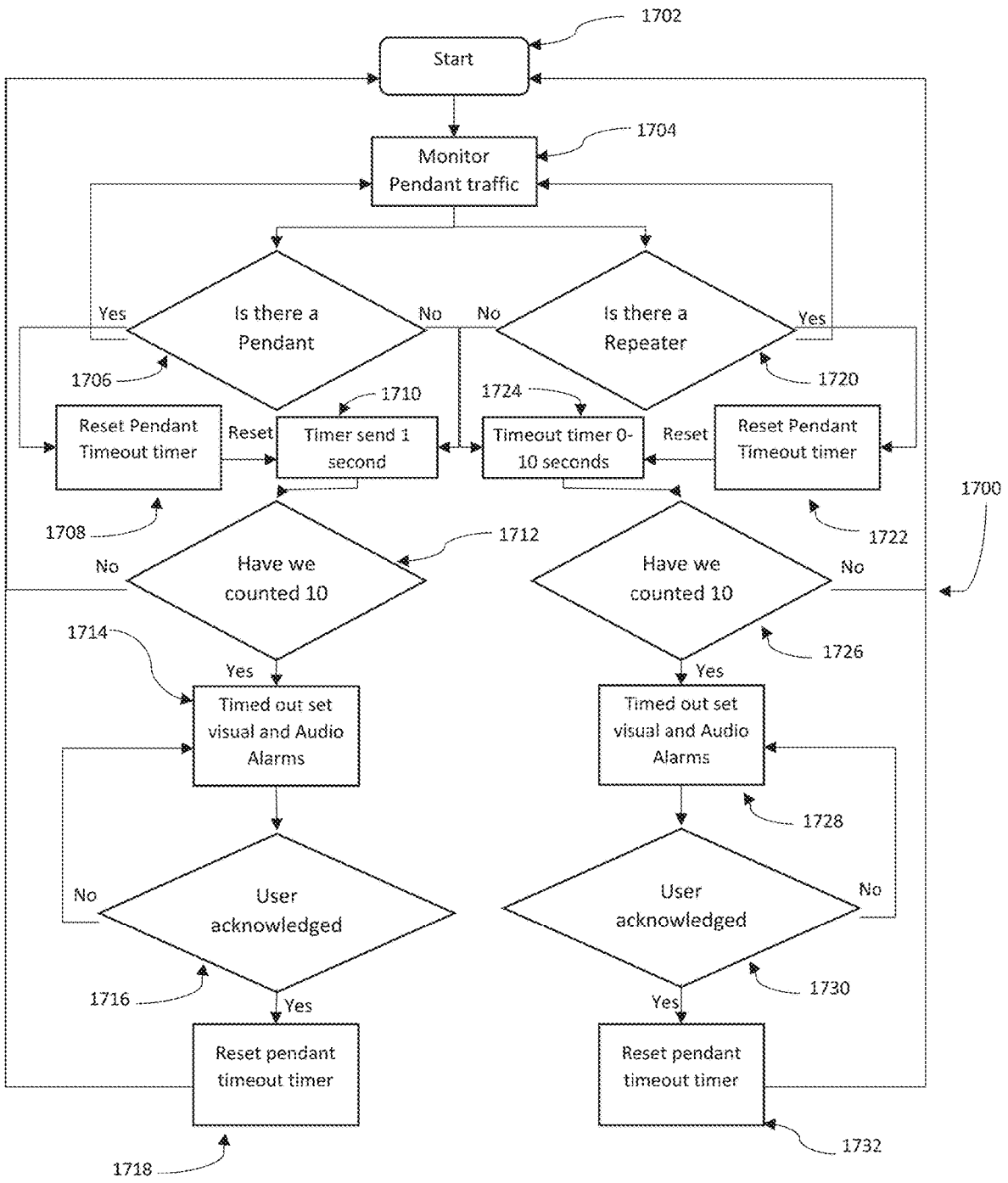
FIG. 17 shows a flowchart for a series of method steps for setting and resetting a pendant in response to a user acknowledgement of an alarm signal received from the wearable device in accordance with an embodiment of the invention.

Referring now to FIG. 17, there is shown a process flow 1700 for monitoring the wearable device (pendant) traffic via the pendant and/or the repeater unit. At step 1702, after being activated, initialised or "started", firstly proceeds to step 1704 where the transceiver actively monitors for signals ("traffic"). If a pendant signal ("packet") is received at step 1706, then the process returns to monitoring at 1704, as the process receives confirmation that the pendant is active. Simultaneously, the pendant timeout timer is reset at step 1708, and the timer increments by one second at step 1710. Once the timer is incremented, a determination is made as to whether 10 seconds have been counted (i.e. the timer has been incremented 10 times) at step 1712. If not, the process flow returns to start step 1702. If so, at step 1714 a timed out condition is generated and a visual and audio alarm is communicated to the user, via the base station and/or mobile device. In other words, if no signal is received after 10 seconds, then the alarm protocol is activated. The base station then awaits a user acknowledgement of the alarm at step 1716. If no acknowledgment is made by the user (generally by pressing a keypad or button on the base station or a button rendered on a screen on the remote computing device), the process returns to step 1714, and the audio and visual alarm is repeated. If the user acknowledges the receipt of the alarm (indicating that they are aware of the potential safety issue), then the process proceeds to step 1718, where the pendant timeout timer is reset and the process returns to start step 1702.

Similarly (and contemporaneously to the process described above with regard to the pendant packet), at step 1704 the process also monitors for pendant signals relayed via a repeater unit. If a repeater signal ("packet") is received at step 1720, then the process returns to monitoring at 1704, as the process receives confirmation that the pendant is active. Simultaneously, the pendant timeout timer is reset at step 1722, and the timer increments by one second at step 1724. Once the timer is incremented, a determination is made as to whether 10 seconds have been counted (i.e. the timer has been incremented 10 times) at step 1726. If not, the process flow returns to start step 1702. If so, at step 1728 a timed out condition is generated and a visual and audio alarm is communicated to the user, via the base station and/or mobile device. The base station then awaits a user acknowledgement of the alarm at step 1730. If no acknowledgment is made by the user (generally by pressing a keypad on the base station or touching a button on the remote computing device), the process returns to step 1728, and the audio and visual alarm is repeated. If the user acknowledges the receipt of the alarm, then the process proceeds to step 1732, where the pendant timeout timer is reset and the process returns to start step 1702. In this manner the pendant and repeater can be constantly monitored, such that the "lack" of a signal is utilised to determine whether there is an issue with the wearable device, the repeater unit and/or the user of the wearable device.

As described above, the present invention provides an embodiment which includes a software application configured to operate the alarm protocol disclosed herein upon receiving information indicative of the wearable device being immersed in water.

Moreover, an embodiment of the present invention provides a software application configured to operate an alarm protocol on a primary mobile computing device upon receiving information indicative of a wearable device in communication with the mobile computing device being immersed in water. The alarm protocol comprises activating an alarm on the primary mobile computing device upon receiving the information, activating an alarm on one or more secondary mobile computing devices if the alarm on the primary mobile computing device is not cancelled within a predetermined period, and repeating the alarm on the primary mobile computing device a predetermined time after the preceding alarm was cancelled, until information indicative of the wearable device no longer being immersed in water is received.

In yet another aspect, the present invention provides a combination of a wearable device configured to transmit a signal when immersed in water and a mobile computing device operating a software application configured to initiate an alarm protocol upon detection of the signal. In some embodiments, the wearable device may be the wearable device disclosed herein. In some embodiments, the alarm protocol may be the alarm protocol disclosed herein.

It is envisaged that the software application, or instructions regarding how to obtain the software application from on-line sources such as iTunes or Google Play, for example, would be sold with the wearable device. Instructions for initialising the application on the purchaser's mobile phone(s) and pairing with the wearable device could be provided on the device's packaging or on-line.

In summary, the invention relates to a wearable device which provides a water safety alarm and supervision aid, but which is viewed by its wearer as a desirable adornment. It will be appreciated that the present invention provides a number of new and useful results when compared with the prior art. For example, specific embodiments of the present invention may provide one or more of the following advantages:

- the device provides a water safety alarm and supervision aid for parents, carers and pet owners;
- due to its visual appeal, the device is more likely to want to be worn by the wearer;
- the visual appeal of the device can be changed to appeal to a particular demographic and can be changed to maintain its appeal as the wearer gets older;
- wearing the device all of the time reduces the risk of the device not being worn at the time it is needed; and
- the device can be paired with sophisticated software application which provides customisable alarm protocols (within safe parameters).

It will be understood to persons skilled in the art of the invention that many modifications may be made without departing from the spirit and scope of the invention. All such modifications are intended to fall within the scope of the following claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A wearable device comprising:

a transmitter for transmitting a signal that is detectable by a remote device configured to cause an alarm on a mobile computing device if the signal is indicative of the device being immersed in water, wherein the alarm comprises an alarm protocol operated by a software application on the mobile computing device, wherein the alarm protocol comprises:

activating an alarm on the mobile computing device immediately upon detecting the signal, and activating an alarm on one or more secondary mobile computing devices, if the alarm on the mobile computing device is not cancelled within a predetermined time, whereby the alarm protocol further comprises repeating the alarm on the mobile computing device if the wearable device is still immersed in water a second predetermined time after a preceding alarm was cancelled; and an interchangeable visual feature.

2. The wearable device of claim 1, wherein the transmitter is configured to transmit a signal which is attenuated when the device is immersed in water, whereby the attenuated signal is indicative of the device being immersed in water and causes the alarm.

3. A wearable device comprising:

sensor for sensing immersion of the device in water;

a transmitter for transmitting a signal when the device is immersed in water, the signal being detectable by a remote device configured to cause an alarm on a mobile computing device upon detection of the signal, wherein the alarm comprises an alarm protocol operated by a software application on the mobile computing device, wherein the alarm protocol comprises:

activating an alarm on the mobile computing device immediately upon detecting the signal, and activating an alarm on one or more secondary mobile computing devices, if the alarm on the mobile computing device is not cancelled within a predetermined time, whereby the alarm protocol further comprises repeating the alarm on the mobile computing device if the wearable device is still immersed in water a second predetermined time after a preceding alarm was cancelled; and an interchangeable visual feature.

4. The wearable device of claim 1, wherein the interchangeable visual feature is configured to be releasably attachable to the device.

5. The wearable device of claim 1, wherein the device is configured to be worn on an ankle, wrist or neck of a person.

6. The wearable device of claim 3, wherein the interchangeable visual feature is configured to be releasably attachable to the device.

* * * * *